US007016264B2

(12) United States Patent
Ueno et al.

(10) Patent No.: US 7,016,264 B2
(45) Date of Patent: Mar. 21, 2006

(54) LIGHT EMISSION AND DISPLAY DEVICES AND ELECTRONIC APPARATUS USING THE DISPLAY DEVICE

(75) Inventors: Masato Ueno, Hachioji (JP); Tadao Hirano, Akiruno (JP); Shyuichi Machida, Ome (JP); Mitsunobu Yatabe, Komae (JP)

(73) Assignee: Casio Computer Co., Ltd., Tokyo (JP)

( * ) Notice: Subject to any disclaimer, the term of this patent is extended or adjusted under 35 U.S.C. 154(b) by 348 days.

(21) Appl. No.: 10/295,650

(22) Filed: Nov. 15, 2002

(65) Prior Publication Data

US 2003/0099160 A1 May 29, 2003

(30) Foreign Application Priority Data

Nov. 29, 2001 (JP) ..... 2001-364612
May 31, 2002 (JP) ..... 2002-159822

(51) Int. Cl.
*G04B 19/30* (2006.01)
*G04B 29/00* (2006.01)
*H01J 1/64* (2006.01)

(52) U.S. Cl. ..... 368/67; 368/227; 368/300; 313/510; 313/513; 362/23

(58) Field of Classification Search ..... 368/67, 368/88, 226, 227, 281, 297–300, 82; 313/510–513; 362/23, 27, 29
See application file for complete search history.

(56) References Cited

U.S. PATENT DOCUMENTS 1,994,950 A * 3/1935 Hoffritz ..... 362/23
3,466,498 A * 9/1969 Koster et al. ..... 368/82
4,208,869 A * 6/1980 Hanaoka ..... 368/84
4,705,407 A 11/1987 Brien
5,604,716 A * 2/1997 Cheung ..... 368/67
5,751,662 A * 5/1998 Shaw ..... 368/67
5,813,753 A * 9/1998 Vriens et al. ..... 362/293
5,898,644 A * 4/1999 Ganter et al. ..... 368/47
6,020,943 A * 2/2000 Sonoda et al. ..... 349/61
6,285,125 B1 * 9/2001 Mizuno ..... 313/512
6,310,836 B1 * 10/2001 Fujii et al. ..... 368/205
6,729,738 B1 * 5/2004 Fuwausa et al. ..... 362/84

FOREIGN PATENT DOCUMENTS

| | | |
|---|---|---|
| CN | 1237078 A | 12/1999 |
| JP | 7-260961 A | 10/1995 |
| JP | 08-160171 A | 6/1996 |
| JP | 9-264969 A | 10/1997 |
| JP | 2001-305571 A | 10/2001 |

* cited by examiner

*Primary Examiner*—Vit W. Miska
(74) *Attorney, Agent, or Firm*—Frishauf, Holtz, Goodman & Chick, P.C.

(57) ABSTRACT

A light emission and display device (for example, timepiece module) comprising an ultraviolet ray emitting element that emits ultraviolet rays, light emission areas that react to the ultraviolet rays to thereby emit the corresponding colored lights, and a pair of legs that connect in a stabilized manner the ultraviolet ray emitting element and a connection terminal of a circuit board in the light emission and display device. Each leg has a bend for adjusting the length and a bend angle of the leg between the ultraviolet ray emitting element and the connection terminal (FIG. 19).

2 Claims, 22 Drawing Sheets

LIGHT EMISSION AND DISPLAY DEVICES AND ELECTRONIC APPARATUS USING THE DISPLAY DEVICE

BACKGROUND OF THE INVENTION

1. Field of the Invention

The present invention relates to light emission and display devices for use in wristwatches, portable telephones and car meters, and electronic apparatus using such light emission and display device.

2. Description of the Prior Art

Electronic apparatus are known that include, for example, a light emission and display device in which a ray emission element connected to a connection terminal provided on a circuit board is caused to emit rays on a user's demand.

It is, however, considered in such electronic apparatus that when the ray emitting element is disposed at more than a predetermined space from the connection terminal, it can not be easily connected electrically to the connection terminal in a stabilized manner due to intermediate elements such as indicators intervening between the ray emitting element and the connection terminal.

SUMMARY OF THE INVENTION

The subject of the present invention is to provide a light emission and display device in which even when the ray emission element is disposed at more than a predetermined space from the connection terminal, the ray emission element can be connected electrically to the connection terminal in a stabilized manner and in which the ray emission element can be located at a desired position to emit rays effectively, and to provide an electronic apparatus including such light emission and display device.

In order to achieve the above object, the present invention provides a connection member that connects the ray emission element disposed on a frame electrically to the connection terminal disposed below the frame.

In addition, in this invention the connection member has a bend at a position along its length depending on the positional relationship between the ray emission element and the connection terminal.

BRIEF DESCRIPTION OF THE DRAWINGS

The invention will now be more thoroughly described and features and advantages will become readily apparent by reading the following detailed description, in which references will be made to the accompanying figures, where.

DESCRIPTION OF THE PREFERRED EMBODIMENTS

Embodiments of wristwatches according to the present invention will be described next in detail with reference to the accompanying drawings.

(First Embodiment)

Figure 1:
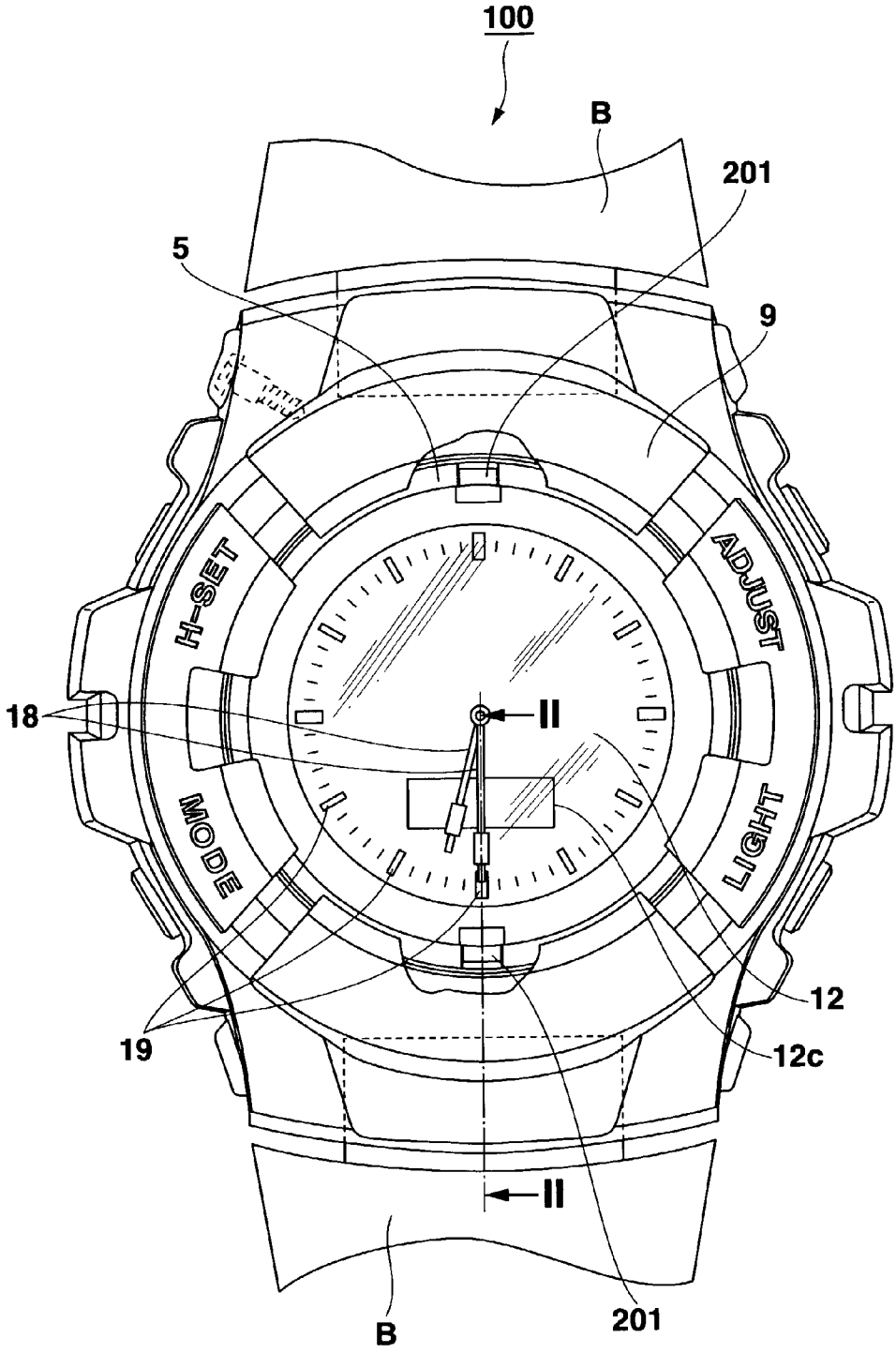
FIG. 1 is a schematic plan view of a first embodiment of a wristwatch according to the present invention with several elements removed for illustrating purposes.
Figure 2:
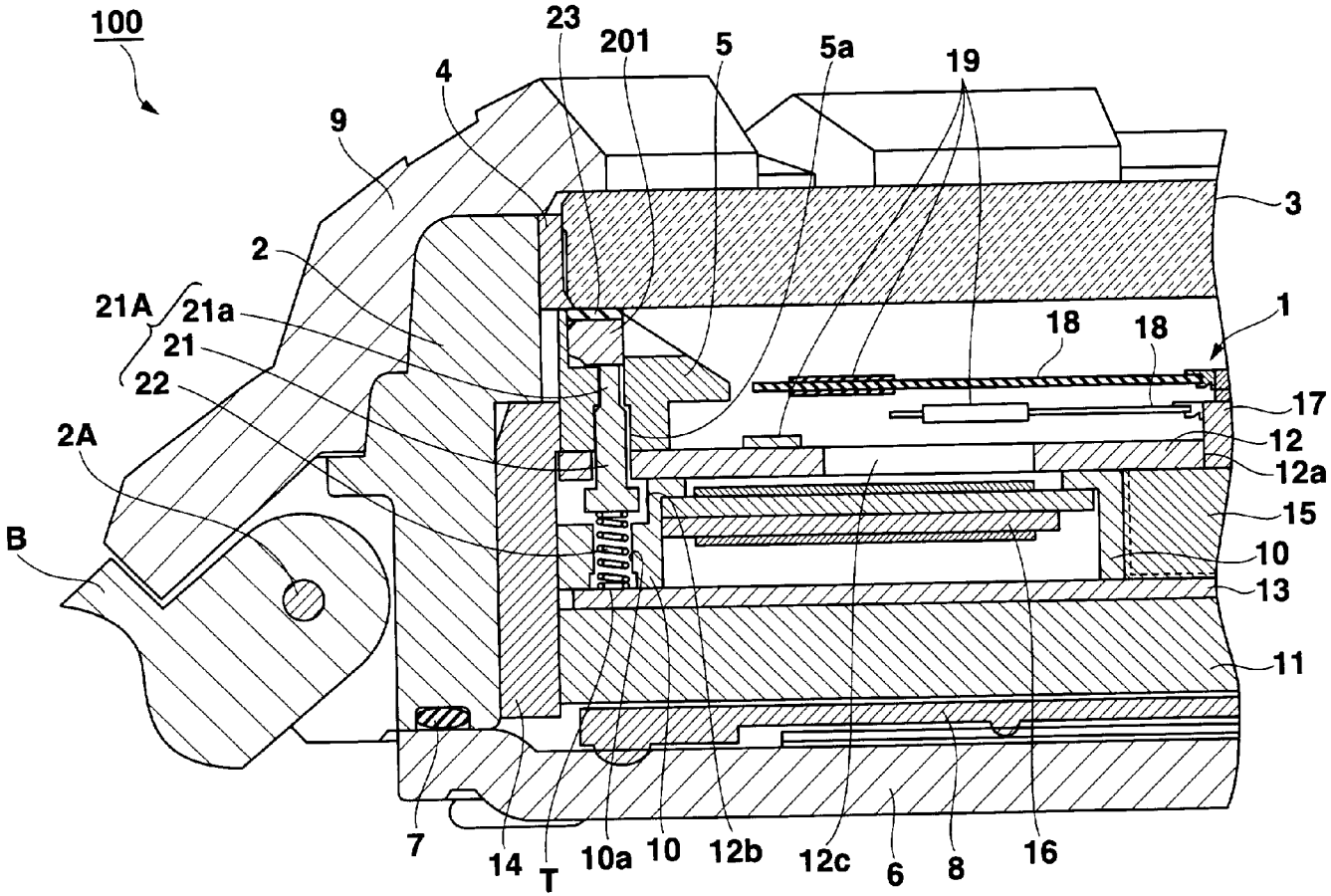
FIG. 2 is an enlarged cross-sectional view of an important portion of the wristwatch taken along a line II—II of FIG. 1.

FIG. 1 is a plan view of a wristwatch according to the present invention. FIG. 2 is an enlarged cross-sectional view of an important portion of the wristwatch taken along a line II—II of FIG. 2.

As shown in FIGS. 1 and 2, the wristwatch 100 comprises a case 2 that houses a timepiece module 1 as a light emission and display device, and a glass cover 3 composing a top of the case 2 through a packing 4. A ring-like frame 5 is provided to the timepiece module 1 so as to abut at an upper end on the glass cover 3. A bottom cover 6 is attached to a lower end of the case 2 through a waterproof ring 7 with a buffer member 8 between the timepiece module 1 and the back cover 6. A bezel 9 is provided so as to surround an upper periphery of the case 2. Bands B are respectively attached to opposite ends of the case 2 through axles 2A.

The timepiece module 1 comprises at least one of analog and digital functions. FIG. 2 shows the timepiece module 1 with both the analog and digital functions. As shown in FIG. 2, the timepiece module 1 comprises an upper housing 10 and a lower housing 11 as intermediate members with a dial plate (intermediate member) 12 on top of the upper housing 10. The ring-like frame 5 is disposed along the periphery of an upper surface of the dial plate 12. A circuit board 13 is provided below the frame 5 between the upper and lower housings 10 and 11 disposed at a predetermined space. The timepiece module 1 has a structure in which the dial plate 12, upper housing 10, circuit board 13 and lower housing 11 are attached to an inner hollow-cylindrical frame 14 of the case 2.

The upper housing 10 houses an analog hand mechanism 15 and a liquid crystal display device 16 whereas the lower housing 11 contains, for example, batteries (not shown) to operate the analog hand mechanism 15 and the liquid crystal display 16.

The analog hand mechanism 15 comprises a hand shaft 17 that extends upwards through a hole 12*a* in the dial plate 12, and hands 18 such as hour and minute hands attached to the hands shaft 17 so as to rotate above the dial plate 12. The dial plate 12 and the hands 18 have light emitting areas 19 provided at predetermined positions thereon such that they are irradiated with rays from a pair of ray emitting elements, which will be described below in more detail, to thereby emit light.

The liquid crystal display device 16 comprises a liquid crystal cell (not shown) that includes an upper and a lower transparent electrode plate between which liquid crystal is enclosed, and a pair of upper and lower polarizing plates between which the liquid crystal cell is disposed. The liquid crystal display device 16 displays information such as the time when a voltage is applied across the pair of electrode plates of the liquid crystal cell. The liquid crystal display device 16 can be viewed through a window 12*c* in the dial plate 12.

While the structure and operation of a left half of the wristwatch in this embodiment will be mainly described below with respect to FIG. 2 for convenience of explanation, this description applies to the right half of the wristwatch, and other embodiments which will be described later.

The frame is made, for example, of a plastic material having an optical permeability, and especially a transparent plastic material. As shown in FIG. 2, the frame 5 is provided on an inner periphery of the case 2 such that it abuts at its upper and lower ends on a periphery of the glass cover 3 and a periphery of the dial plate 12 (upper housing 10), respectively. Two ultraviolet ray-emitting elements 201 called a black light are disposed at predetermined positions, for example, of 12 and 6 o'clock on the frame 5, as shown in FIG. 1. The frame 5 also functions as a protective or buffering member. Each ultraviolet ray emitting element 201 comprises an ultraviolet ray lamp or emitting diode that emits ultraviolet rays, for example, having a wavelength of 254–420, 374–389, and preferably proximately 365 nanometers.

Figure 3A:
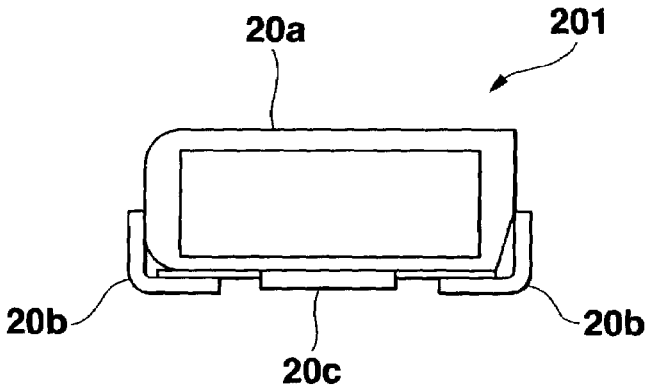
FIG. 3A is a front view of an ultraviolet ray-emitting element used in each of the first and a second embodiment according to the present invention.
Figure 3B:
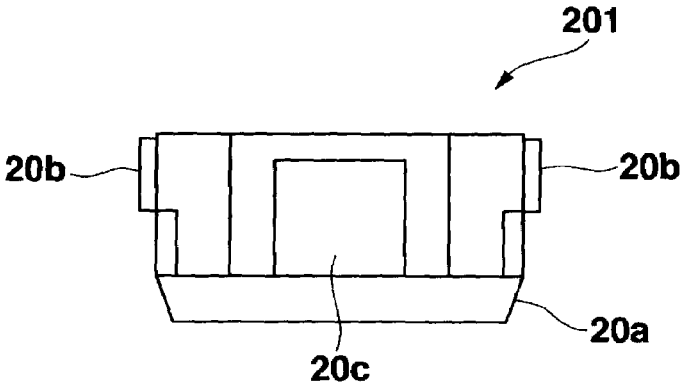
FIG. 3B is a bottom view of the ultraviolet ray-emitting element used in each of the first and second embodiments.
Figure 3C:
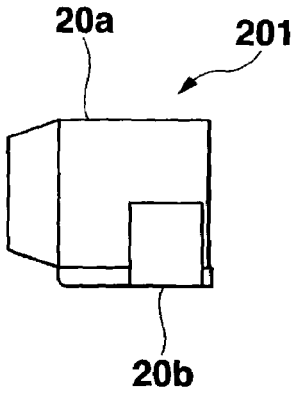
FIG. 3C is a side view of the ultraviolet ray-emitting element used in each of the first and second embodiments.

For example, as shown in FIGS. 3A, 3B and 3C each ultraviolet ray emitting element 201 comprises a ray output 20*a*, a pair of electrode terminals 20*b* extending from the bottom of the ray output 20*a* around the respective corners of the ray output 20*a*, and a buffer member 20*c* provided at substantially the center of the bottom of the ray output 20*a*.

Figure 4:
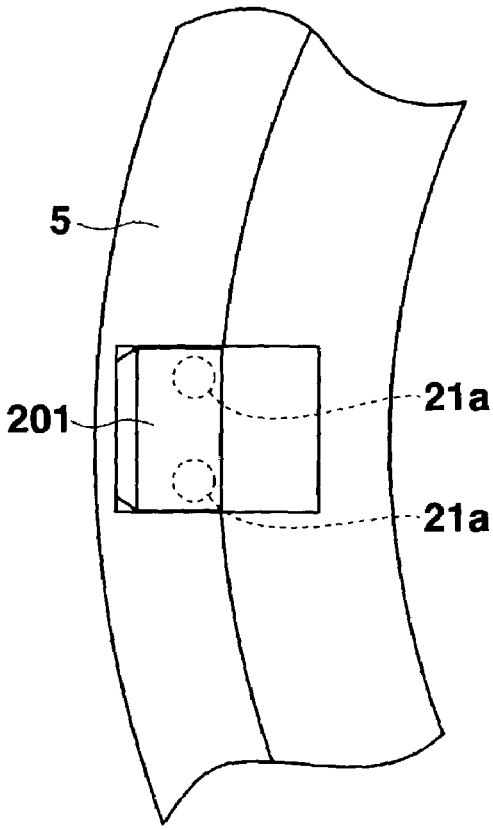
FIG. 4 is an enlarged plan view of that portion of a frame in which the ultraviolet ray emitting element used in the first-a fourth embodiment according to the present invention is disposed.

As shown in FIGS. 2 and 4, the ultraviolet ray emitting element 201 is embedded in the frame 5 such that ultraviolet rays emitted from the ultraviolet ray emitting element 201 enter the optically transparent frame 5, which functions as a ray conducting member to thereby emit the ultraviolet rays from its entire surface to the outside. Therefore, a position distant inward from the ultraviolet ray-emitting element 201 is irradiated with the ultraviolet rays through the frame 5. Since the two ultraviolet ray emitting elements 201 are disposed, for example, at 12 and 6 o'clock positions, respectively, on a diameter of the wristwatch, as shown in FIG. 1, the elements or areas concerned are irradiated efficiently with the ultraviolet rays.

As shown in FIG. 2, the ultraviolet ray emitting element 201 is fixedly supported by a pair of connection members 21A each of which includes a rod-like contact member 21 abutting on the ultraviolet ray emitting element 201, and a coil spring 22 functioning to press the contact member 21 against the ultraviolet ray emitting element 201(only one connection member is shown in FIG. 2). Each contact member 21 has a support shaft 21*a* in contact with a respective one of the pair of electrode terminals 20*b*, respectively, of the ultraviolet ray-emitting element 201.

The contact member 21 is made of an electrically conductive material, and extends through a hole 10*a* in the upper housing 10, a hole 12*b* in the dial plate 12, and a hole 5*a* in the frame 5. The frame 5 has an upper protrusion on which the ultraviolet ray-emitting element 201 is supported by the pair of support shafts 21*a*. A buffer member 23 is provided between the glass cover 3 and the ray output 20*a* of the ultraviolet ray-emitting element 201.

Each coil spring 22 is made of an electrically conductive material and received within the hole 10*a* provided in the upper housing 10 so as to have upper and lower ends elastically pressed against a lower end of the contact member 21 and a contact terminal T formed on the circuit board 13, respectively. Thus, the coil springs 22 press the respective contact members 21 against the ultraviolet ray-emitting element 201 and supports it elastically. The ultraviolet ray-emitting element 201 is connected electrically to the circuit board 13 by the pair of connection members 21A that include the contact member 21 and the pair of coil springs 22.

Figure 5:
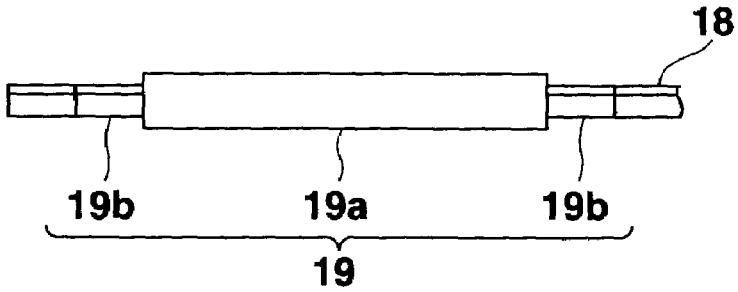
FIG. 5 is an enlarged view of a time hand of FIG. 2.

As shown in FIGS. 2 and 5, the light emitting areas 19 are formed as a plastic area 19*a* and a printed or coated light-emitting material area 19*b* at predetermined positions on the dial plate 12, for example, on marks and hour numerals and/or hands 18 of the analog hand mechanism 15. The light emitting areas 19 are preferably protected at their upper surfaces with transparent films (not shown).

Those light emitting areas 19 react to ultraviolet rays having a wavelength, for example, of 350–420 or 254–365 nanometers directly from the ultraviolet ray-emitting element 201 or through the light-transparent frame 5 to emit the corresponding colored lights. The light emitting areas are transparent in a normal state when not irradiated with ultraviolet rays.

The colors of lights to be emitted by the light emitting areas 19 include three basic colors, that is, green (or yellow), blue and red and their various variations. The light emitting areas 19 provided on the respective timepiece parts may emit the same colored light, but in order to visually recognize the time easily, the light emitting areas 19 on at least the dial plate 12 and the hands 18 emit respective different-colored lights preferably. For example, the light emitting areas 19 on the dial plate 12 and the hands 18 preferably emit red and blue lights, respectively. The light emitting areas 19 on the marks and hour numerals on the dial plate 12 may emit respective different-colored lights. The light emitting areas 19 on the respective hour numerals may emit different-colored lights as well.

As just described above, according to the wristwatch of the first embodiment each ultraviolet ray emitting element 201 is connected electrically to the circuit board 13 through the pair of electrically conductive connection members 21A even when the ultraviolet ray emitting element 201 is disposed at a position distant from the circuit board 13. Therefore, the light emitting areas 19 distant from the circuit board 13 are effectively irradiated with ultraviolet rays from the ultraviolet ray emitting element 201 concerned.

Since the ultraviolet ray emitting element 201 is secured elastically within the case 2 by the pair of connection members 21A, each of which includes the contact member 21 and coil spring 22, the coil springs 22 can absorb shocks which the case 2 may receive externally.

When wristwatches are different in size and type, their time modules 1 and the upper housings 10 are generally different in thickness. In addition, the respective elements may have errors in dimensions. Thus, the distances from their ultraviolet ray emitting elements 201 to the corresponding circuit boards 13 may not be the same. In these cases, however, it is ensured that the ultraviolet ray emitting element 201 is elastically secured within the case 2 by the pair of coil springs 22, and the ultraviolet ray emitting element 201 is electrically connected easily to the circuit board 13 within the timepiece module 1.

The ultraviolet ray emitting element 201 is capable of emitting ultraviolet rays on demand to thereby cause the respective light emitting areas 19 to emit the corresponding colored lights and to thereby allow the time to be visually recognized well. Display excellent in color and ornament is achieved. Especially, the ultraviolet rays emitted by the ultraviolet ray emitting element 201 enters the light-transparent frame 5, which guides the ultraviolet rays and emits them from its entire inner peripheral surface so as to strike the light emitting areas 19. Thus, the light emitting areas 19 distant from the ultraviolet ray emitting elements 201 emit the corresponding different-colored lights.

Figure 6:
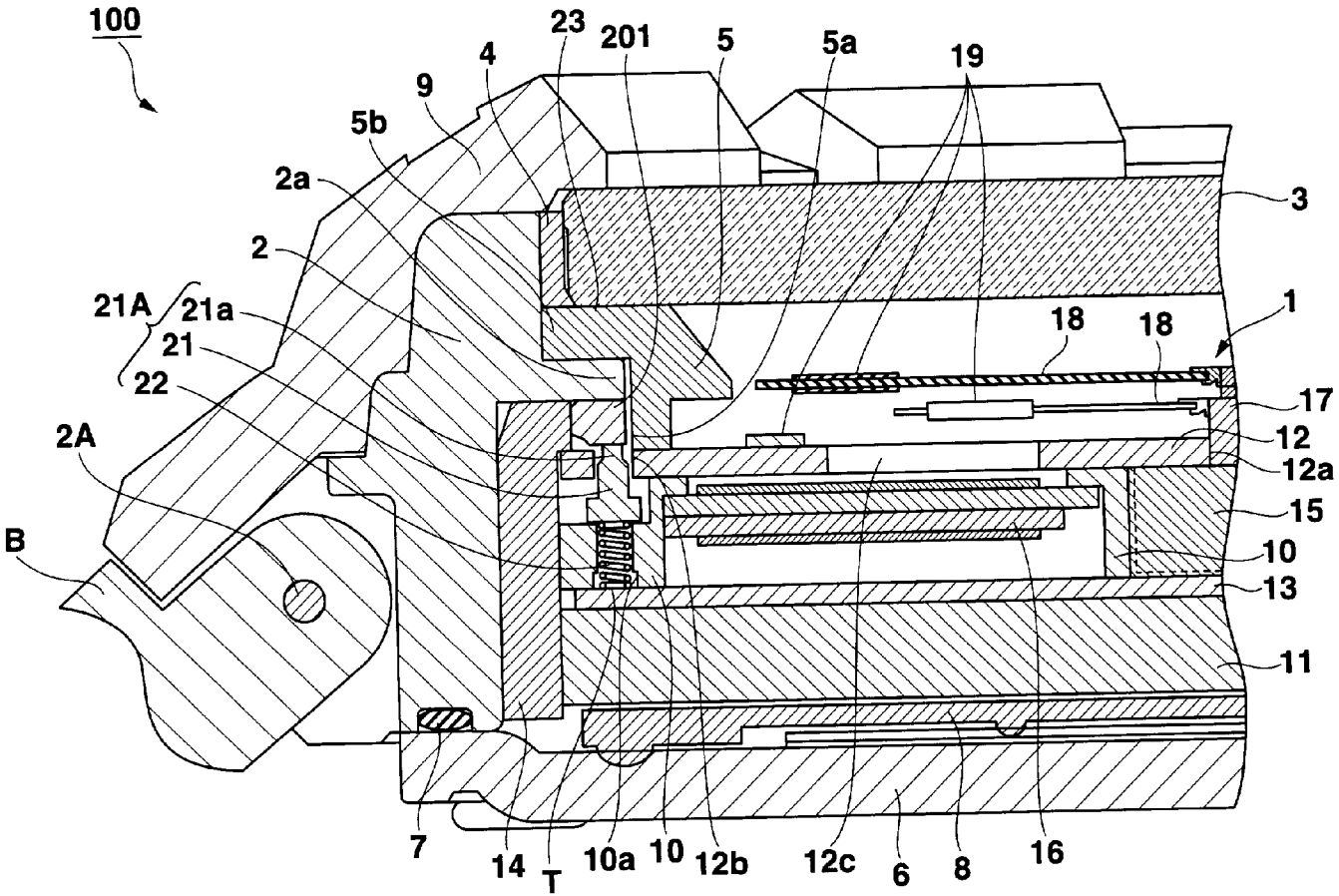
FIG. 6 is an enlarged cross-sectional view of an important portion of a first modification of the first embodiment.
Figure 7:
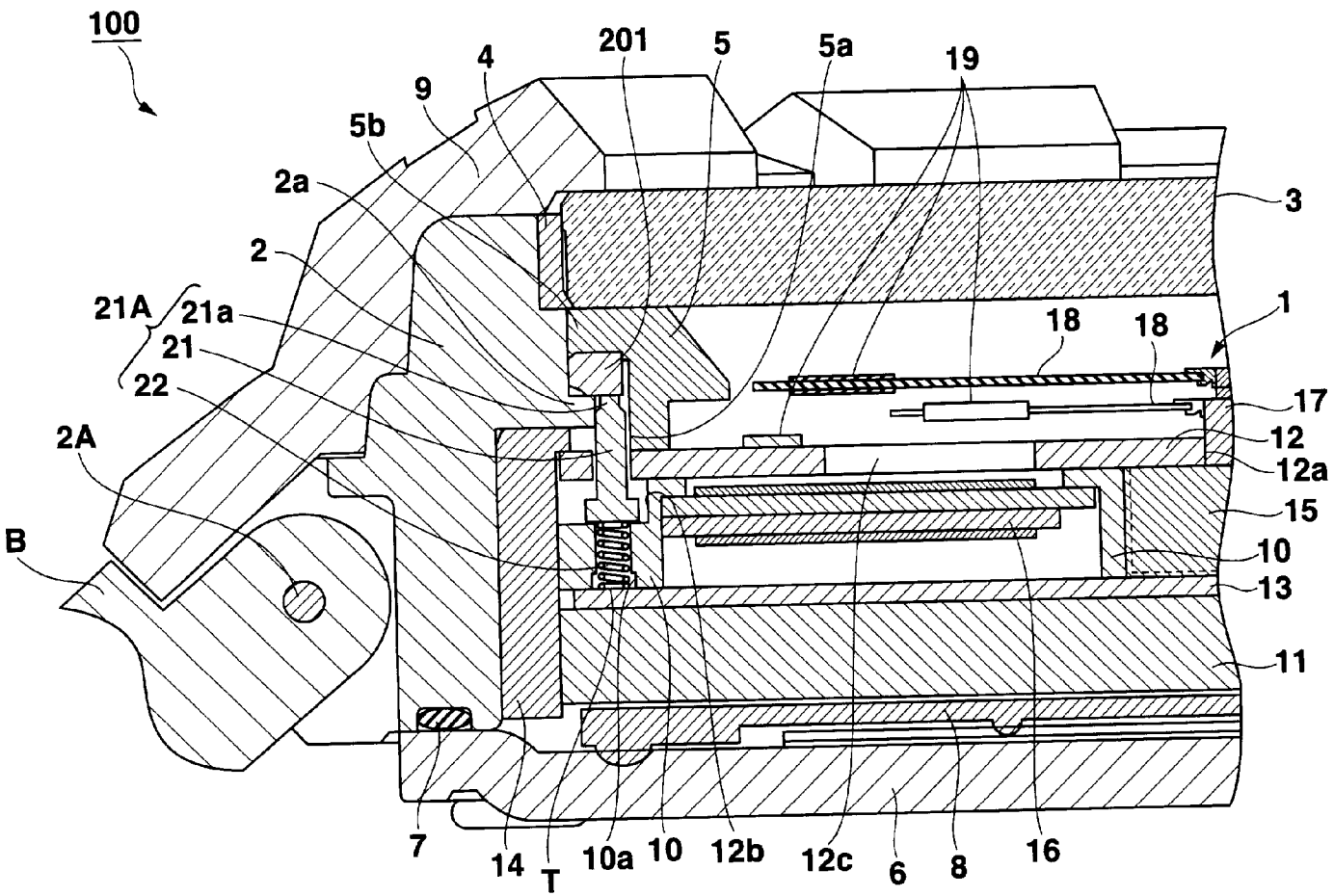
FIG. 7 is an enlarged cross-sectional view of an important portion of a second modification of the first embodiment.

Especially, since the ultraviolet ray emitting elements 201 are disposed at the outer periphery of the frame 5, as shown in FIG. 6 or 7, most of the ultraviolet rays emitted by the ultraviolet ray emitting elements 201 enter the light-transparent frame to thereby achieve efficient irradiation.

Even when the upper housing 10 and the dial plate 12 are provided as intermediate members between the frame 5 and the connection terminals T of the circuit board 13, the pair of contact members 21 extends through the holes 10*a* and 12*b* in the upper housing 10 and the dial plate 12 to thereby achieve connection between the ultraviolet ray emitting element 201 and the connection terminals T of the circuit board 13.

While in the first embodiment the pair of ultraviolet ray emitting elements 201 is illustrated as provided over the frame 5, the present invention is not limited to this particular case. For example, a modification of FIG. 6 or 7 may be employed.

More specifically, as shown in the modification of FIG. 6, a protrusion 2*a* that extends inward from the inner periphery of the case 2 is provided at a position distant upwards from the periphery of the dial plate 12. Each ultraviolet ray-emitting element 201 is disposed between the protrusion 2*a* and the dial plate 12 at the outer lower periphery of the frame 5. The ultraviolet ray emitting element 201 is supported fixedly by the pair of connection members 21A, each of which includes the contact member 21 and the coil spring 22. This structure also produces advantageous effects similar to those produced by the structure of FIG. 2.

As shown in a modification of FIG. 7, a protrusion 2*a* that extends inward from the inner periphery of the case 2 may be provided at a position distant upwards from the periphery of the dial plate 12. Each ultraviolet ray-emitting element 201 may be disposed between the inward protrusion 2*a* and a protrusion 5*b* extending outwards from an upper portion of the frame 5 at the outer periphery of the frame 5. The ultraviolet ray-emitting element 201 may be supported fixedly by the pair of connection members 21A, each of which includes the contact member 21 and the coil spring 22. This structure also produces advantageous effects similar to those produced by the structure of FIG. 2.

The connection of the ultraviolet ray emitting element 201 to the circuit board 13 by the pair of connection members 21A, each of which includes the contact member 21 and the coil spring 22, as described in the first embodiment, is effective when the distance between the ultraviolet ray emitting element 201 and the circuit board 13 is too large for only the pair of coil springs 22 to connect them, so that the pair of coil springs 22 may be deformed, for example in the form of buckling, to thereby cause bad connection.

(Second Embodiment)

Figure 8:
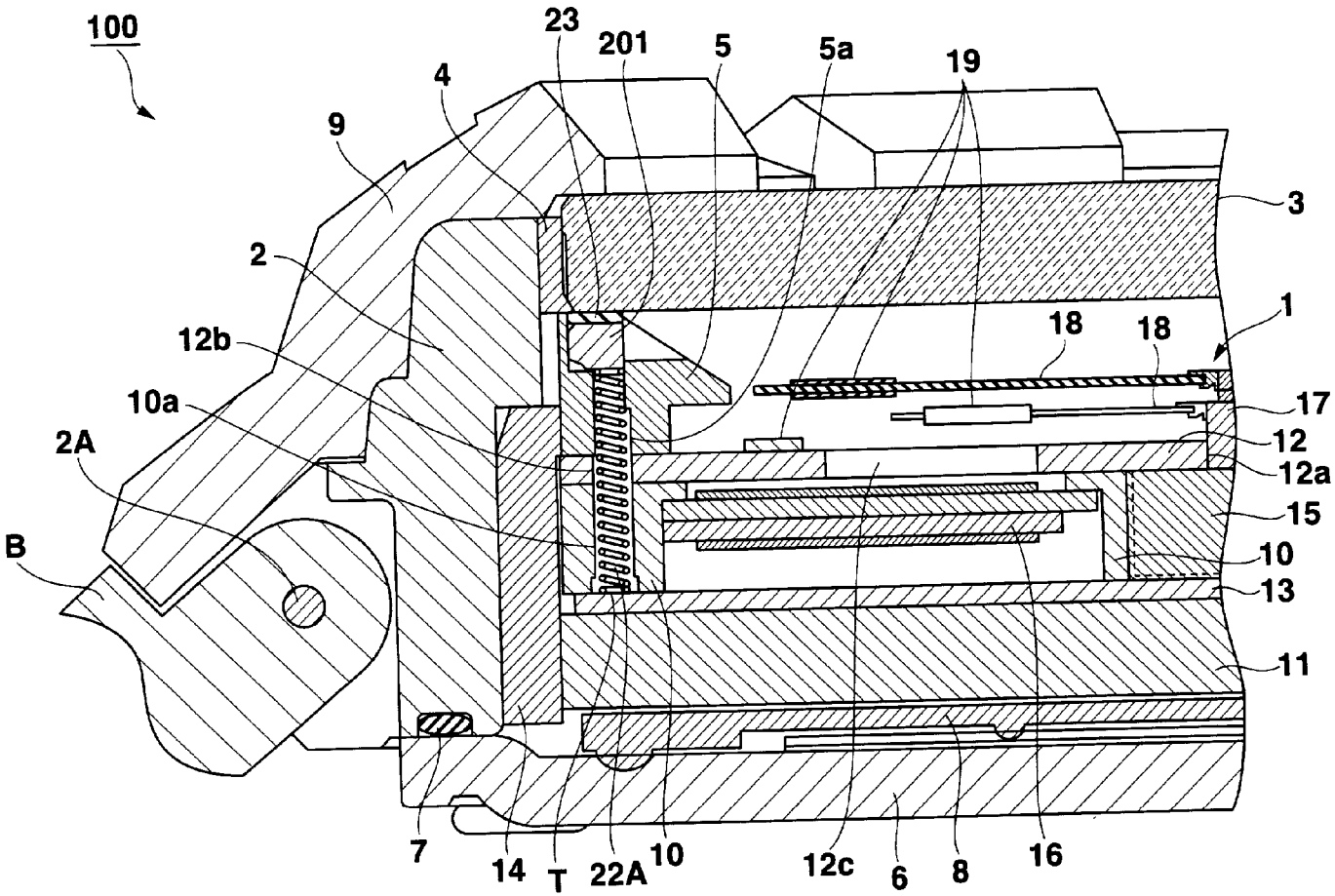
FIG. 8 is an enlarged cross-sectional view of an important portion of the second embodiment.

Referring to FIG. 8, a second embodiment of the wristwatch according to the present invention will be described next. The elements of the second embodiment identical or similar to those of the first embodiment are denoted by reference numerals similar or identical to those used in the first embodiment, and the elements of the second embodiment different from those of the first embodiment will be mainly described.

As shown in FIG. 8, the ultraviolet ray emitting element 201 is supported fixedly by a pair of coil springs 22A (only one of which is shown), each of which composes a connection or pressing member abutting on a respective one of the electrode terminals T of the ultraviolet ray emitting element 201.

Each coil spring 22A is made of an electrically conductive material and extends through holes 10*a*, 12*b* and 5*a* in the upper housing 10, dial plate 12 and frame 5, respectively, so as to abut on the ultraviolet ray emitting element 201. The coil spring 22A has a lower end in elastic contact with the corresponding connection terminal T of the circuit board 13.

Thus, the pair of coil springs 22A elastically supports the ultraviolet ray emitting element 201 in a pressing manner so as to bring the ultraviolet ray emitting element 201 into electrical contact with the circuit board 13 through the pair of coil springs 22A.

As described above, according to the second embodiment of the wristwatch, even when the ultraviolet ray emitting element 201 is disposed at a certain space from the circuit board 13, the ultraviolet ray emitting element 201 is electrically connected to the circuit board 13 through the pair of electrically conductive coil springs 22A so that the light emitting areas 19 distant from the circuit board 13 are irradiated effectively with ultraviolet rays from the ultraviolet ray emitting element 201 concerned.

In addition, since the ultraviolet ray emitting element 201 is elastically supported by the pair of coil springs 22A within the case 2, the coil springs 22 can absorb possible shocks given to the case 2 externally. Even when in the respective wristwatches the distances from the ultraviolet ray emitting element 201 to the circuit board 13 are different, it is ensured that the respective ultraviolet ray emitting elements 201 are secured within the cases 2 due to elastic deformation of the pairs of coil springs 22A and that the ultraviolet ray emitting elements 201 are electrically connected easily to the respective circuit boards 13.

Especially, only the pair of coil springs 22A is used to support the single ultraviolet ray emitting element 201 fixedly in the second embodiment to thereby facilitate assembling the coil springs 22A and to reduce the cost whereas the pair of combined connection members (the contact member 21 and the spring) is used in the first embodiment.

While in the second embodiment the ultraviolet ray emitting elements 201 are illustrated as provided above the frame 5, the present invention is not limited to this particular case. For example, a modification of FIG. 9 or 10 may be employed.

Figure 9:
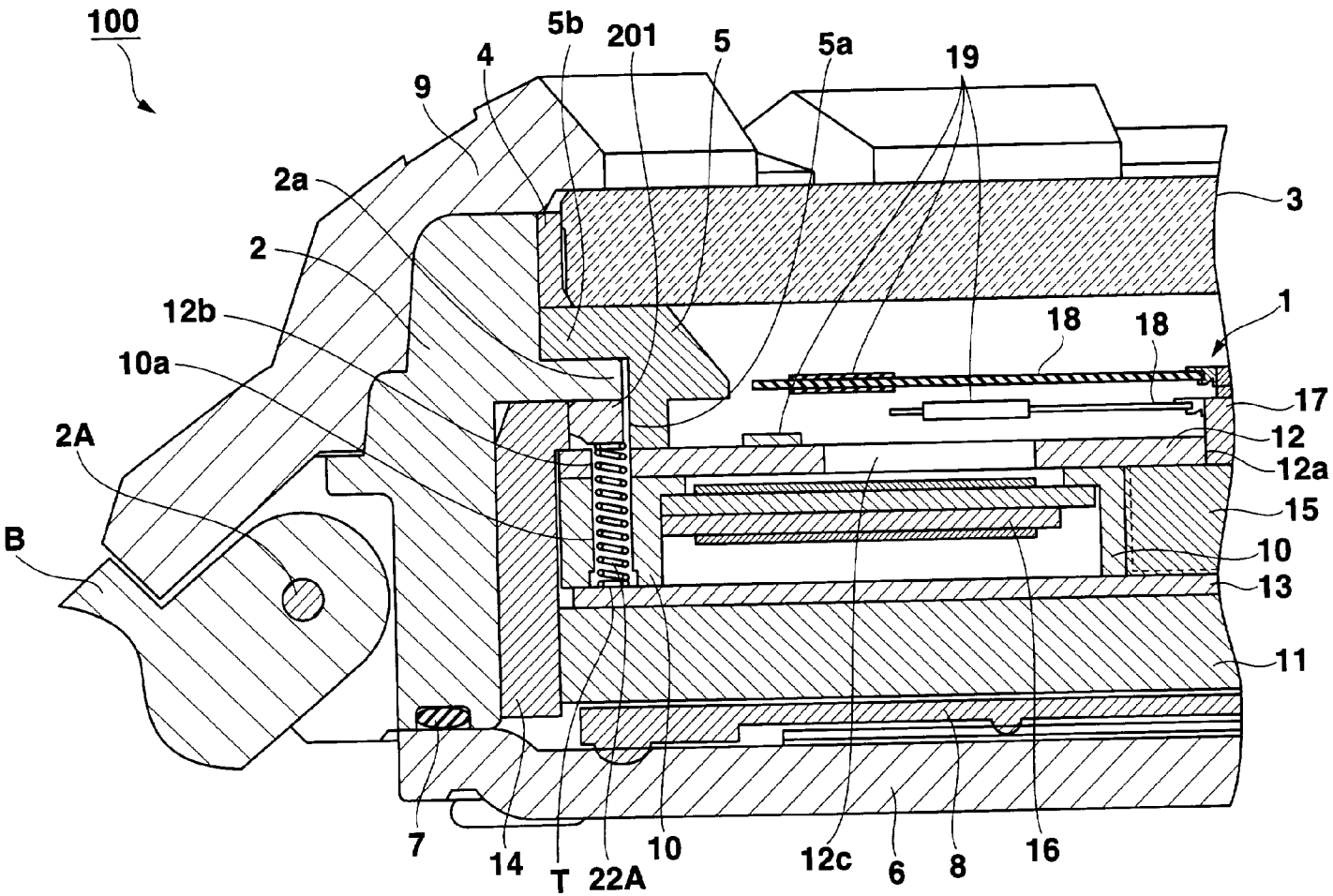
FIG. 9 is an enlarged cross-sectional view of an important portion of a first modification of the second embodiment of the wristwatch.

More specifically, as shown in the modification of FIG. 9, a protrusion 2*a* that extends inward from the inner periphery of the case 2 is provided at a position distant upwards from the outer periphery of the dial plate 12. An ultraviolet ray emitting elements 201 is disposed between the protrusion 2*a* and the dial plate 12 at the outer lower periphery of the frame 5. The ultraviolet ray-emitting element 201 is supported fixedly by the pair of coil springs 22A This structure also produces advantageous effects similar to those produced by the structure of FIG. 8.

Figure 10:
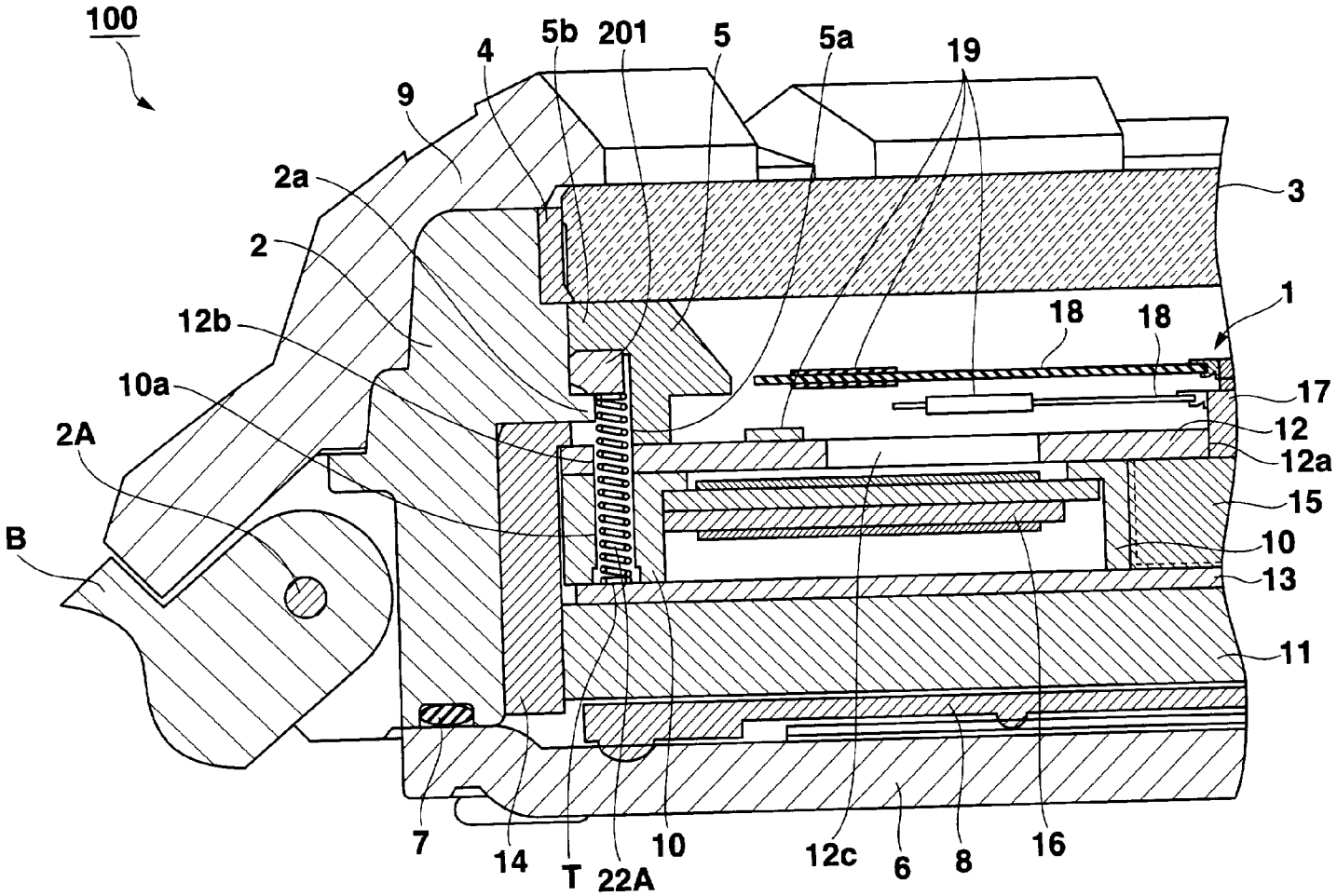
FIG. 10 is an enlarged cross-sectional view of an important portion of a second modification of the second embodiment of the wristwatch.

As shown in the modification of FIG. 10, a protrusion 2*a* that extends inward from the inner periphery of the case 2 may be provided at a position distant slightly upwards from the outer periphery of the dial plate 12. An ultraviolet ray-emitting element 201 may be disposed between the inward protrusion 2*a* and a protrusion 5*b* extending outwards from an upper portion of the frame 5 at the outer periphery of the frame 5. The ultraviolet ray-emitting element 201 may be supported fixedly by a pair of coil springs 22A This structure also produces advantageous effects similar to those produced by the structure of FIG. 8.

(Third Embodiment)

Referring to FIGS. 11A, 11B, 11C and 12, a third embodiment of the wristwatch according to the present invention will be described next. The elements of the third embodiment identical or similar to those of the first embodiment are denoted by reference numerals similar or identical to those used in the first embodiment. The elements of the third embodiment different from those of the first embodiment will be mainly described.

Figure 11C:
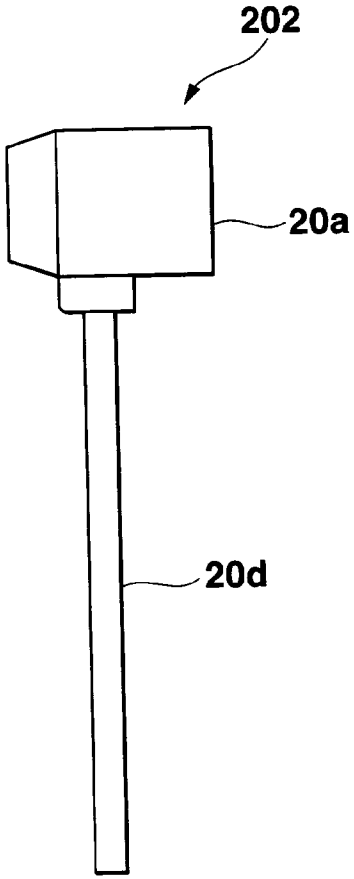
FIG. 11C is a side view of the ultraviolet ray-emitting element used in each of the third and fourth embodiments.
Figure 11B:
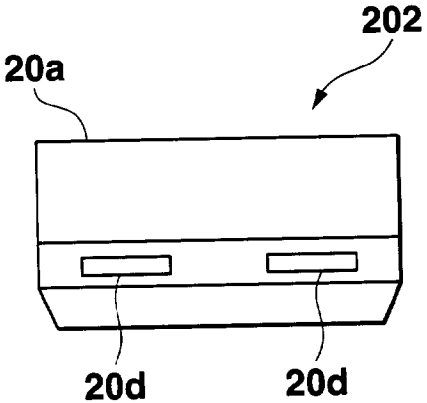
FIG. 11B is a bottom view of the ultraviolet ray-emitting element used in each of the third and fourth embodiments.
Figure 11A:
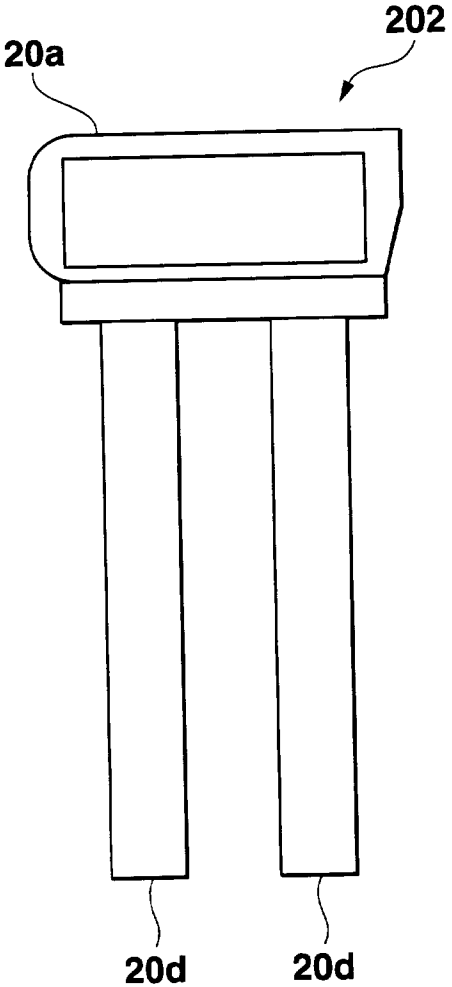
FIG. 11A is a front view of an ultraviolet ray-emitting element used in each of a third and a fourth embodiment according to the present invention.

As shown in FIGS. 11A, 11B and 11C, the ultraviolet ray emitting elements 202 have a ray output 20*a* and a pair of parallel straight legs 20*d* as electrode terminals or connection or contact members extending from the ray output 20*a*. Since the ultraviolet ray-emitting element 202 is different in shape from the ultraviolet ray-emitting element 201, they are identified by different reference numerals.

Figure 12:
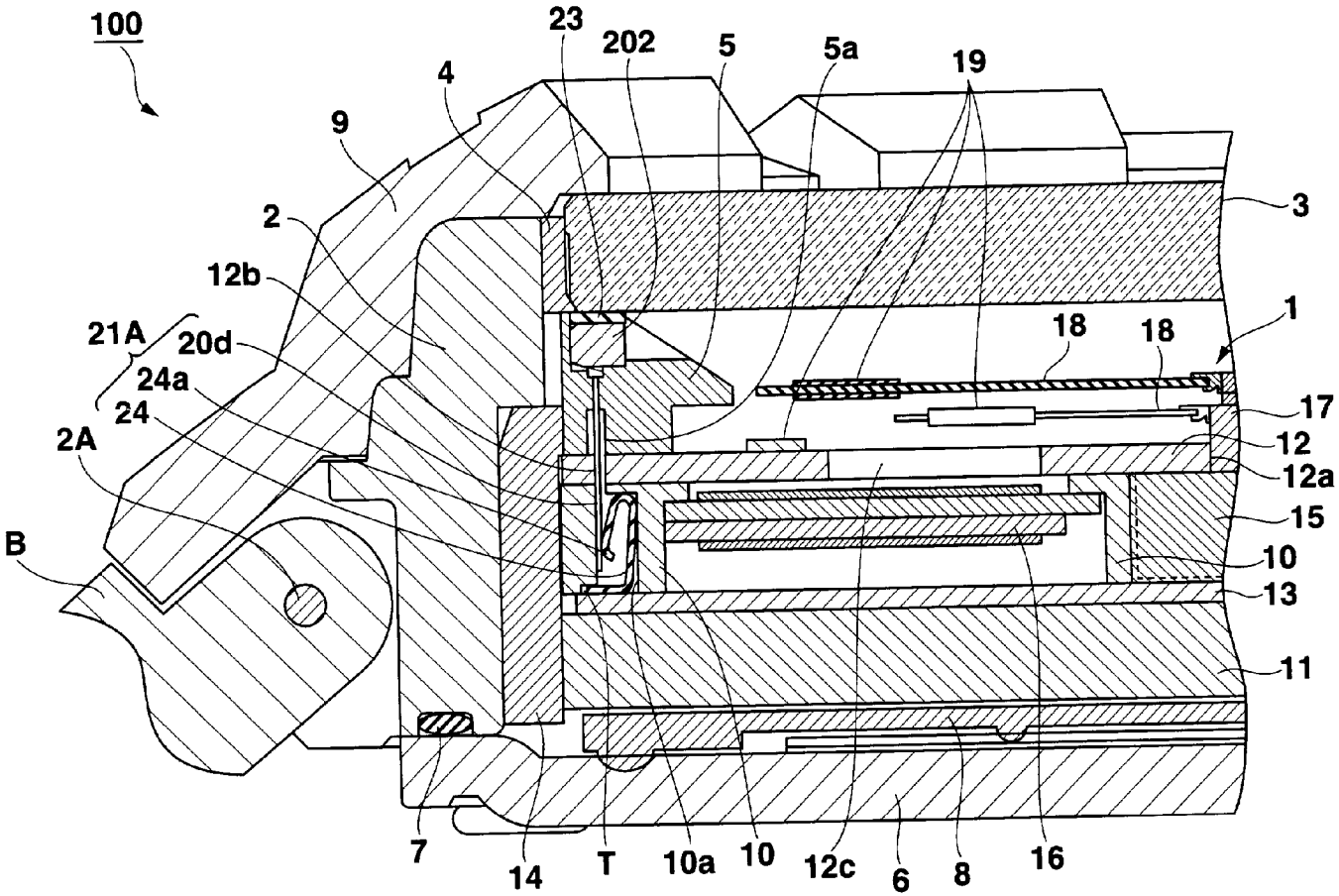
FIG. 12 is an enlarged cross-sectional view of an important portion of a third embodiment of the wristwatch according to the present invention.

As shown in FIG. 12, the pair of legs 20*d* of the ultraviolet ray-emitting element 202 extends through holes 5*a*, 12*b* and 10*a* in the frame 5, dial plate 12 and upper housing 10, respectively. Provided within the hole 10*a* is a pair of electrically conductive securing or connecting members 24 connected to connection terminals T of the circuit board 13. Each securing member 24 has a bent end 24*a* that is elastically deformed to thereby press the securing member 24 against an internal surface of the hole 10*a* as well as to press itself against the corresponding legs 20*d* to thereby hold the legs. Thus, the ultraviolet ray-emitting element 202 is supported securely and connected electrically to the circuit board 13.

As described above, according to the wristwatch of the third embodiment, even when the ultraviolet ray emitting element 202 is disposed distant from the circuit board 13, the ultraviolet ray emitting element 201 can be electrically connected to the circuit board 13 through the pair of electrically conductive securing members 24 so that the light emitting areas 19 distant from the circuit board 13 are irradiated effectively with ultraviolet rays from the ultraviolet ray emitting element 202.

The ultraviolet ray emitting element 202 can be caused to emit ultraviolet rays on demand to thereby cause the respective light emitting areas 19 to emit corresponding colored lights. Since the ultraviolet ray emitting element 202 is releasably secured at its legs 20*d* by the corresponding securing members 24 in a pressed state, the legs 20*d* can be released from the pressed state to thereby allow the ultraviolet ray emitting element 202 to be exchanged with another easily, and the ultraviolet ray emitting element 202 can be electrically connected to the circuit board 13 in the timepiece module 1.

While in the third embodiment the ray outputs 20*a* of the ultraviolet ray-emitting element 202 is illustrated as provided above the frame 5, the present invention is not limited to this particular case. For example, a modification of FIG. 13 or 14 may be employed.

Figure 13:
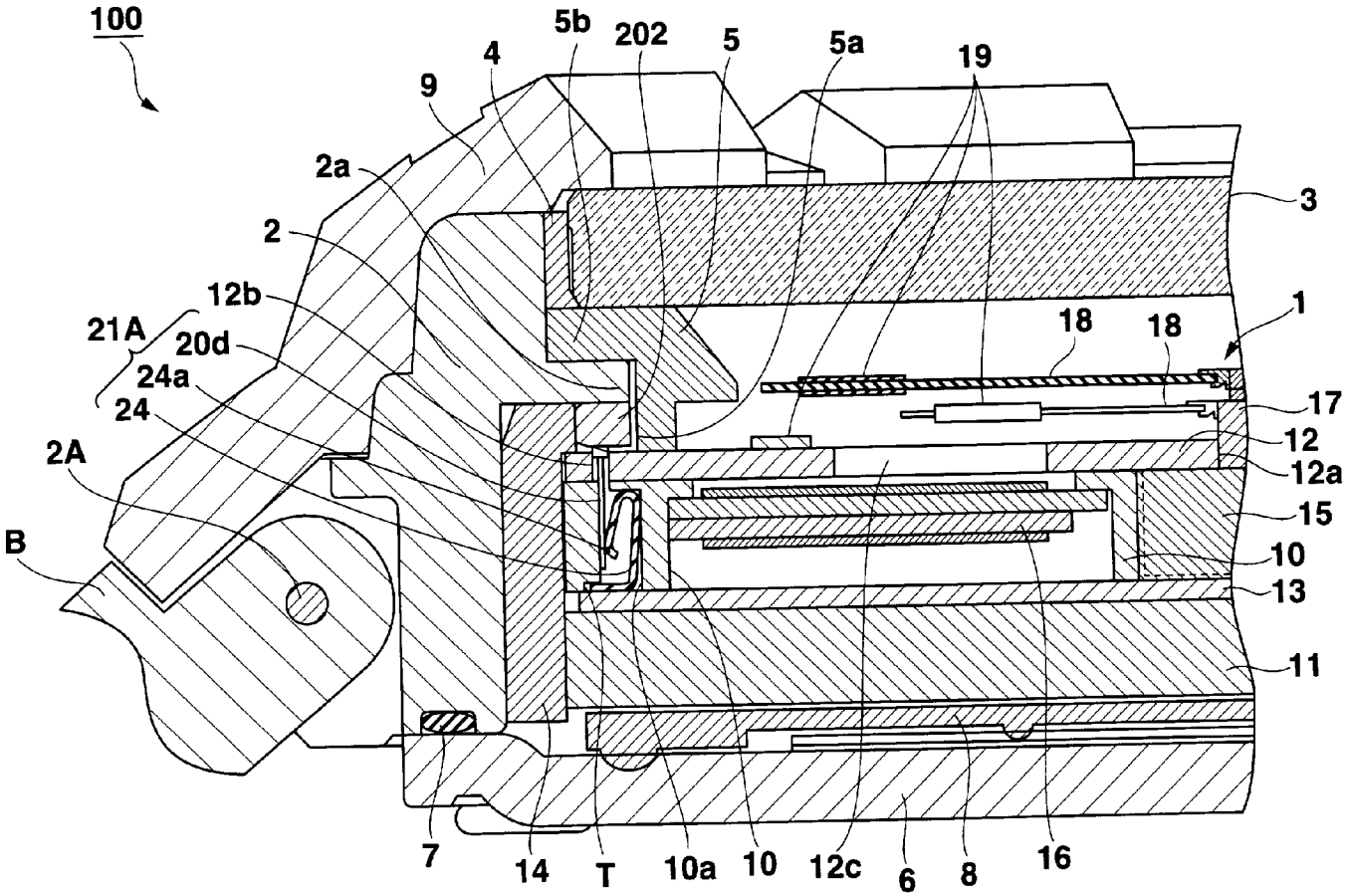
FIG. 13 is an enlarged cross-sectional view of an important portion of a first modification of the third embodiment.

More specifically, for example, as shown in a modification of FIG. 13, a protrusion 2*a* extending inward from the inner periphery of the case 2 may be provided at a position distant upwards from the outer periphery of the dial plate 12 such that the ray output 20*a* of the ultraviolet ray emitting element 202 is disposed between the inward protrusion 2*a* and the dial plate 12 at the outer lower periphery of the frame 5. The ultraviolet ray-emitting element 202 is then secured elastically at its legs 20*d* by the corresponding securing members 24. This structure also produces advantageous effects similar to those produced by the structure of FIG. 12.

Figure 14:
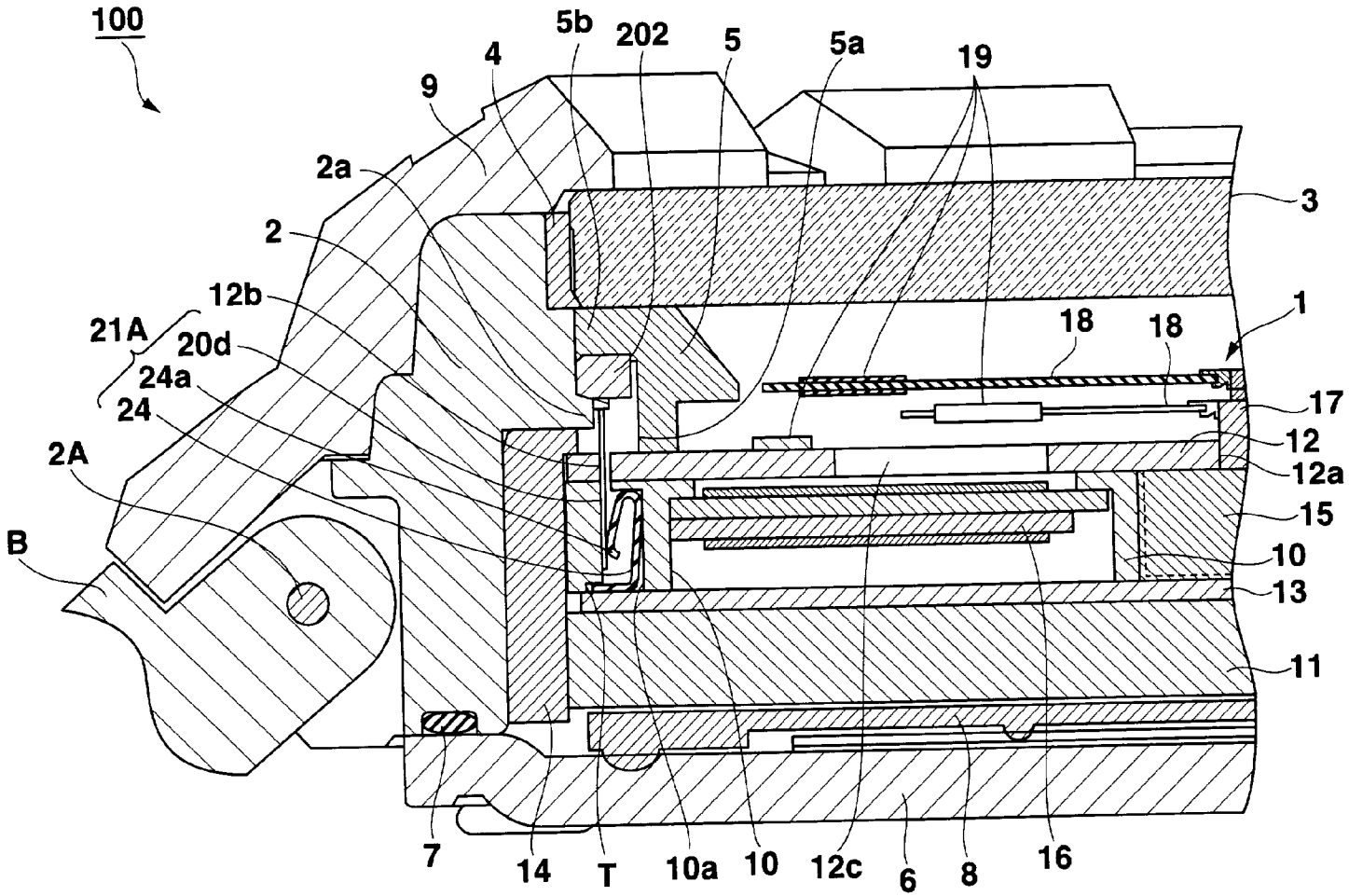
FIG. 14 is an enlarged cross-sectional view of an important portion of a second modification of the third embodiment of the wristwatch.

As shown in a modification of FIG. 14, a protrusion 2*a* extending inward from the inner periphery of the case 2 may be provided at a position distant upwards from the outer periphery of the dial plate 12 such that the ray output 20*a* of the ultraviolet ray emitting element 202 is disposed between the inward protrusion 2*a* and a protrusion 5*b* below extending outward from an upper portion of the frame 5 at the outer periphery of the frame 5. The ultraviolet ray-emitting element 202 is then secured elastically at its legs 20*d* by the corresponding securing members 24. This structure also produces advantageous effects similar to those produced by the structure of FIG. 12.

(Fourth Embodiment)

Figure 15:
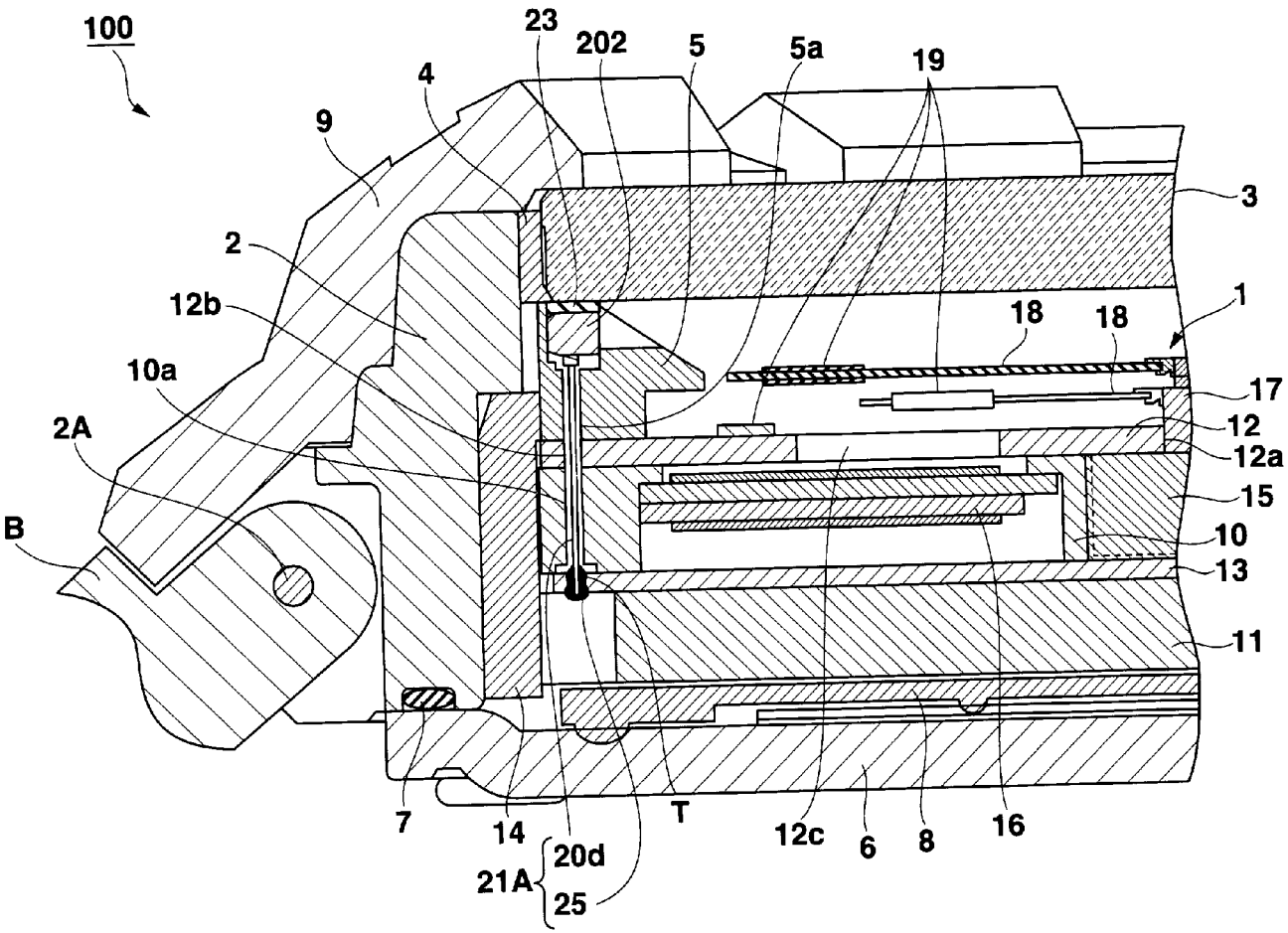
FIG. 15 is an enlarged cross-sectional view of an important portion of a fourth embodiment of the wristwatch according to the present invention.

Referring to FIG. 15, a fourth embodiment of the wristwatch according to the present invention will be described next. The elements of the fourth embodiment identical or similar to those of the first embodiment are denoted by reference numerals similar or identical to those used in the first embodiment. The elements of the third embodiment different from those of the first embodiment will be mainly described.

As shown in FIG. 15, a pair of legs 20*d* of the ultraviolet ray-emitting element 202 extends through holes 5*a*, 12*b* and 10*a* in the frame 5, dial plate 12 and upper housing 10, respectively. The legs 20*d* are soldered at their lower ends 25 to the connection terminals T of the circuit board 13 to thereby secure the ultraviolet ray-emitting element 202. Thus, the ultraviolet ray-emitting element 202 is electrically connected to the circuit board 13.

As described above, according to the fourth embodiment, even when the ultraviolet ray emitting element 202 is distant from the circuit board 13 as in the first embodiment, the legs 20*d* can be soldered at their ends to the connection terminals T so as to electrically connect the circuit board 13 to the circuit board 13 whereby the light emitting areas 19 distant from the circuit board 13 are irradiated effectively with ultraviolet rays from the ultraviolet ray emitting element 202.

The ultraviolet ray emitting element 202 can be caused to emit ultraviolet rays on demand to thereby cause the respective light emitting areas 19 to emit corresponding colored lights. Since the ultraviolet ray emitting element 202 is held at its legs 20*d* by soldering at 25, inexpensive connection where the number of parts to be used is reduced is achieved to thereby reduce the cost of the wristwatch.

While in the fourth embodiment the ray outputs 20*a* of the ultraviolet ray emitting elements 202 are illustrated as provided over the frame 5, the present invention is not limited to this particular case. For example, a modification of FIG. 16 or 17 may be employed.

Figure 16:
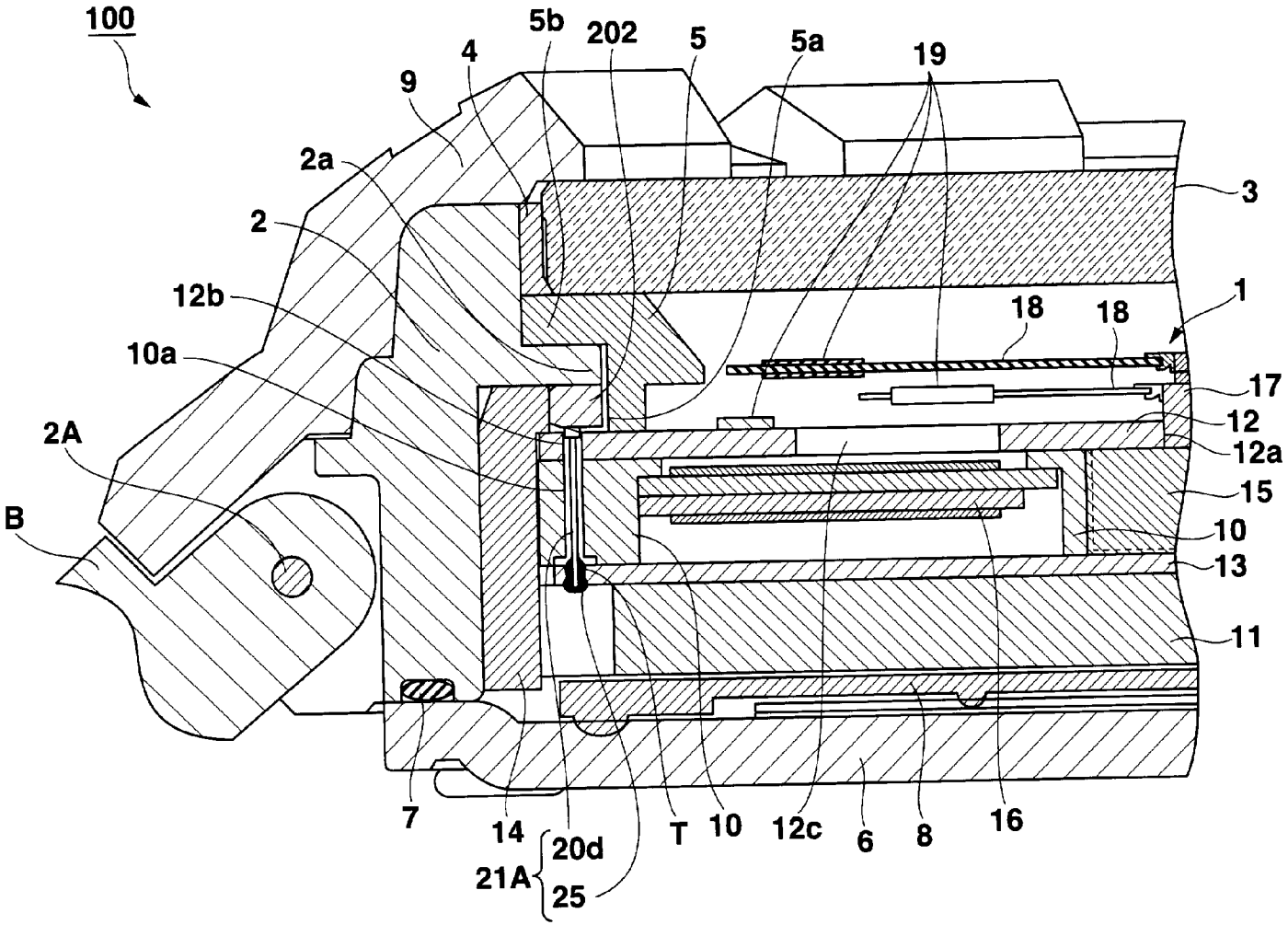
FIG. 16 is an enlarged cross-sectional view of an important portion of a first modification of the fourth embodiment of the wristwatch.

More specifically, for example as shown in the modification of FIG. 16, a protrusion 2*a* extending inward from the inner periphery of the case 2 may be provided at a position distant upwards from the outer periphery of the dial plate 12 such that the ray output 20*a* of the ultraviolet ray emitting element 202 is disposed between the inward protrusion 2*a* and the dial plate 12 below at the outer lower periphery of the frame 5. The ultraviolet ray-emitting element 202 is then secured at its legs 20*d* by soldering at 25 to the connection terminals T. This structure also produces advantageous effects similar to those produced by the structure of FIG. 15.

Figure 17:
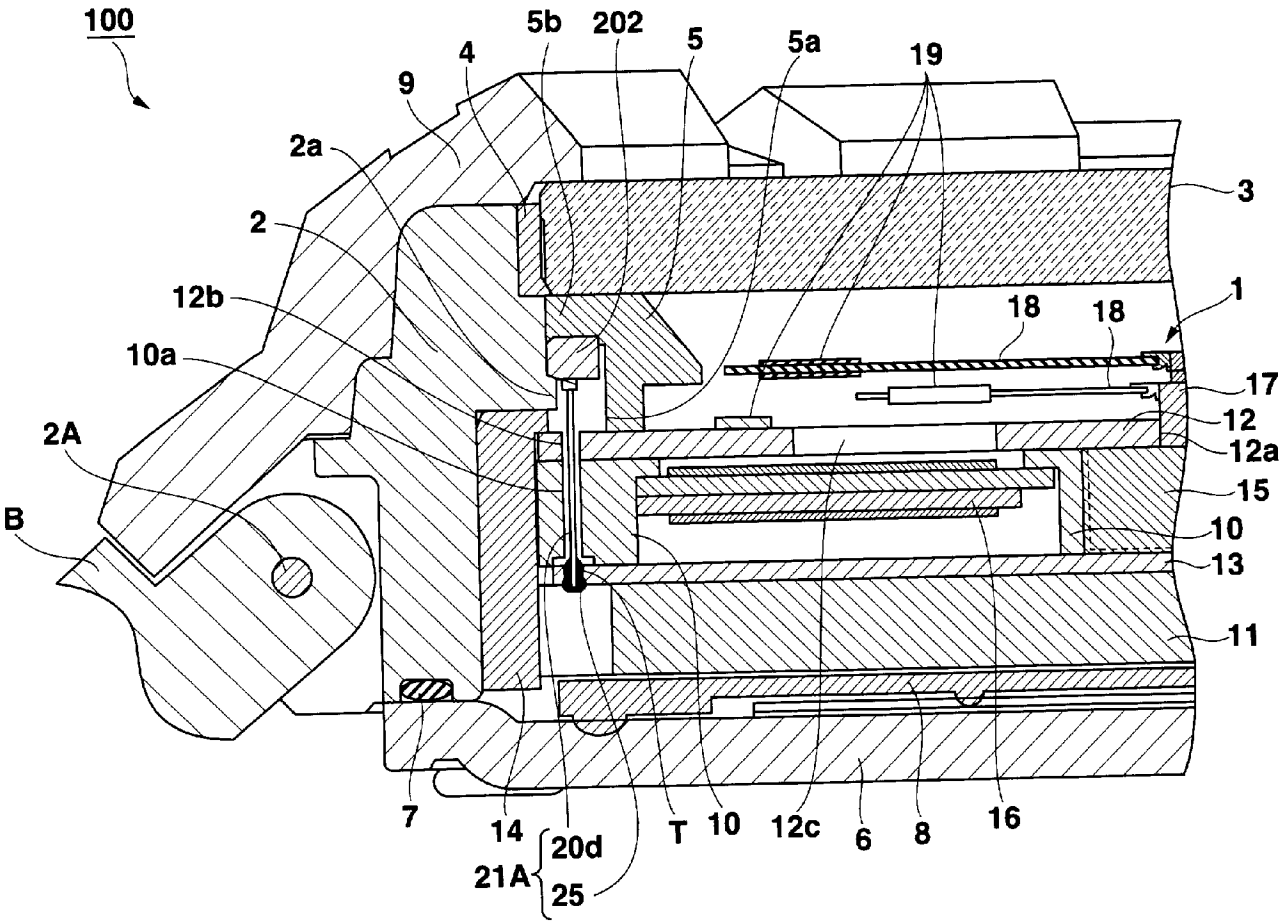
FIG. 17 is an enlarged cross-sectional view of an important portion of a second modification of the fourth embodiment.

As shown in the modification of FIG. 17, a protrusion 2*a* extending inward from the inner periphery of the case 2 may be provided at a position distant upwards from the outer periphery of the dial plate 12 such that the ray output 20*a* of the ultraviolet ray emitting element 202 is disposed between the inward protrusion 2*a* and a protrusion 5*b* extending outward from an upper portion of the frame 5 at the outer periphery of the frame 5. The ultraviolet ray-emitting element 202 is then secured at its legs 20*d* by soldering at 25 to the connection terminals T. This structure also produces advantageous effects similar to those produced by the structure of FIG. 15.

(Fifth Embodiment)

Figure 18:
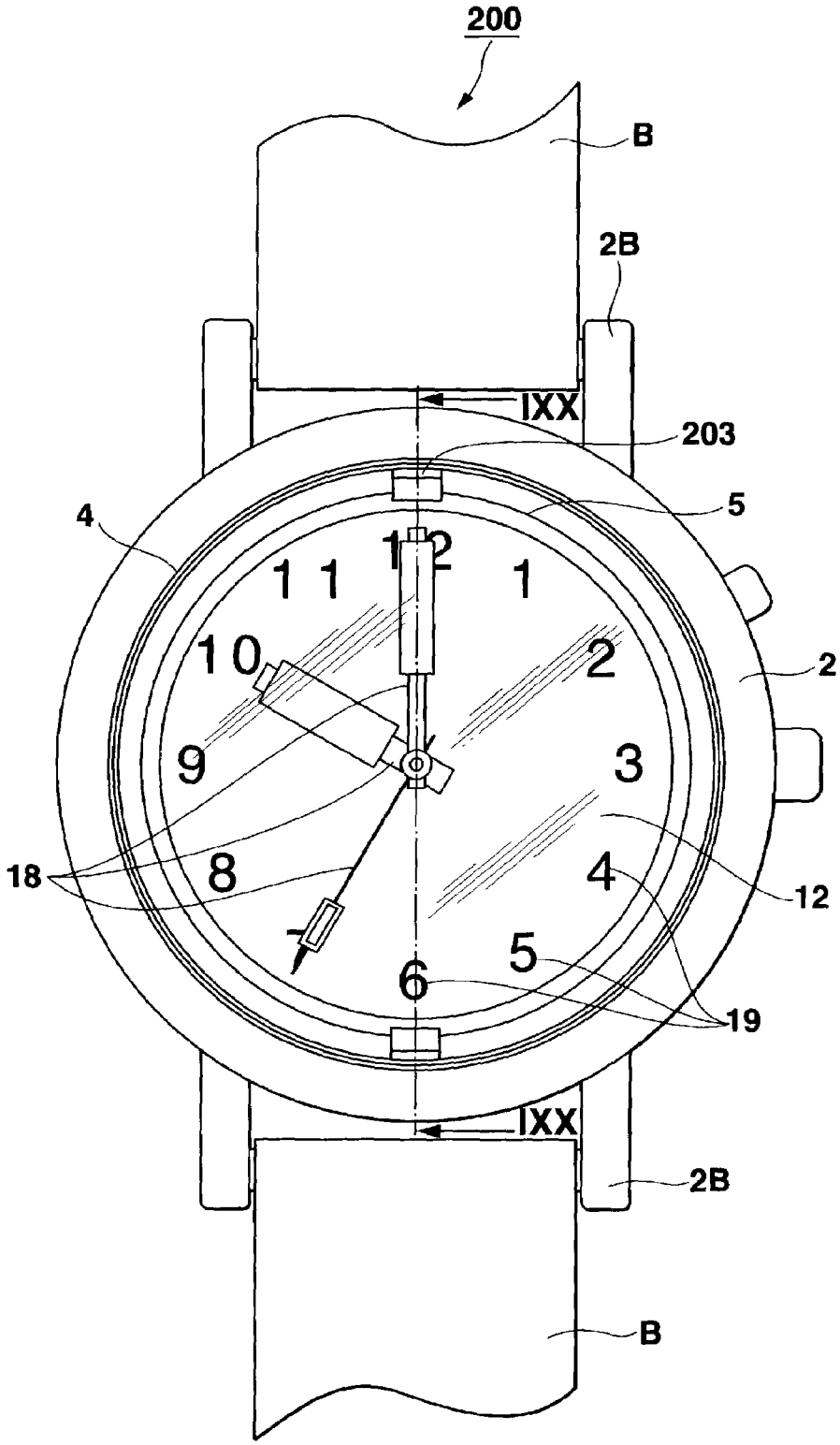
FIG. 18 is a plan view of a fifth embodiment of the wristwatch according to the present invention with several parts removed for illustrating purposes.
Figure 19:
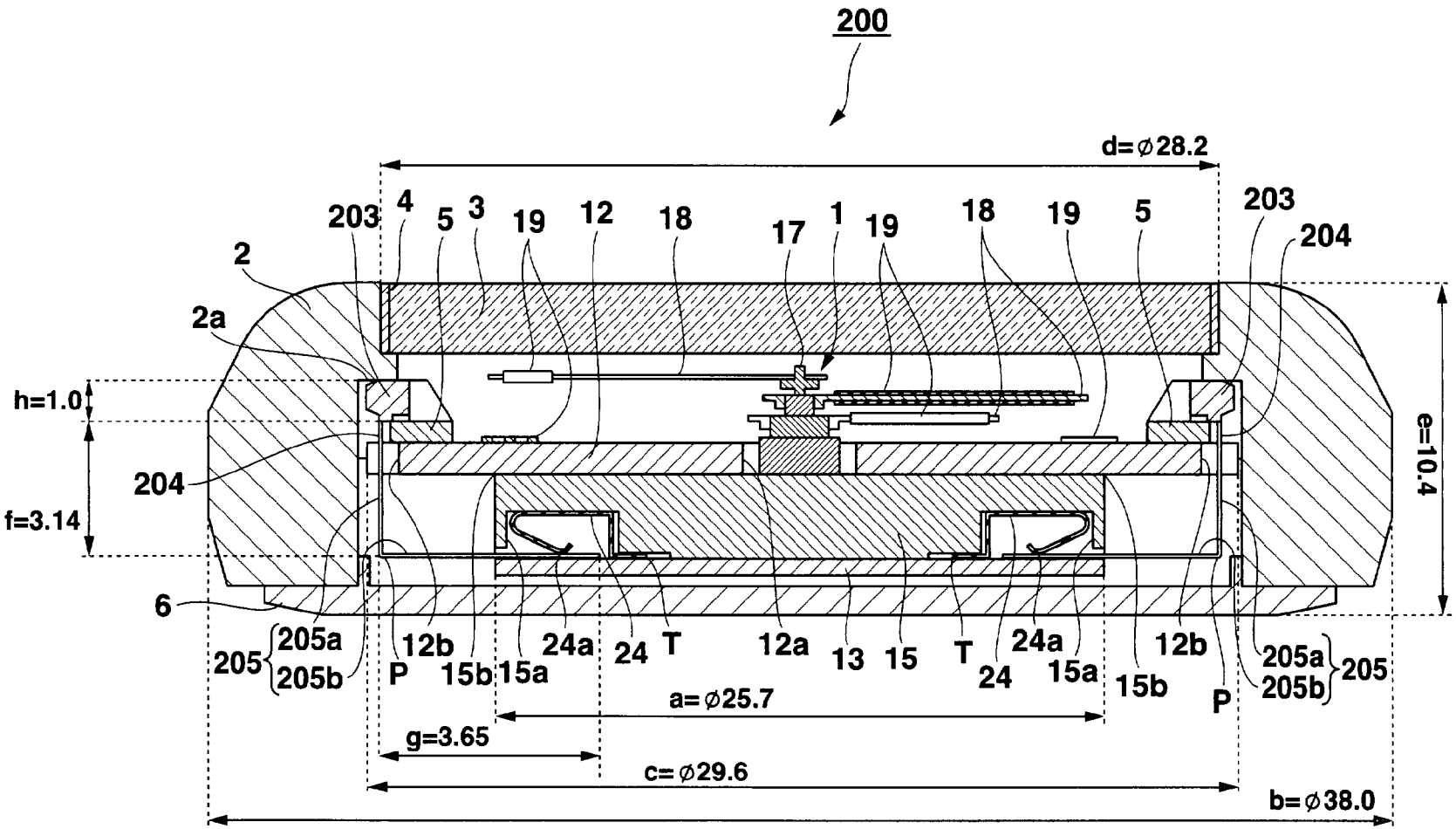
FIG. 19 is an enlarged cross-sectional view of an important portion of the wristwatch taken along a line IXX—IXX of FIG. 18.

Referring to FIG. 18–23, a fifth embodiment of the wristwatch according to the present invention will be described next. FIG. 18 is a plan view of the fifth embodiment. FIG. 19 is an enlarged cross-sectional view of the wristwatch taken along a line IXX—IXX of FIG. 18. The elements of the fifth embodiment identical or similar to those of the first embodiment are denoted by reference numerals similar or identical to those used in the first embodiment. The elements of the third embodiment different from those of the first embodiment will be mainly described.

Figure 20:
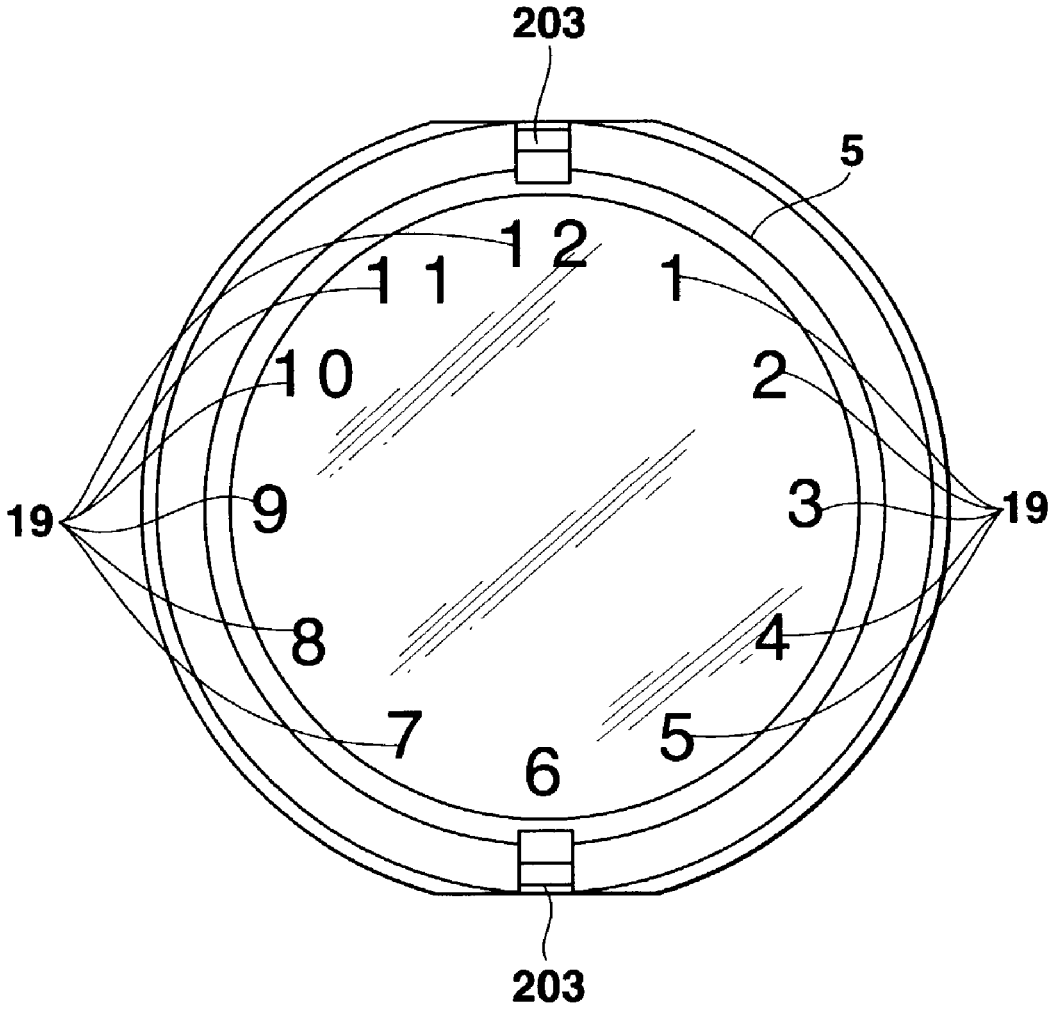
FIG. 20 is a plan view of a frame and its vicinity of the fifth embodiment.

As shown in FIGS. 18 and 19, the wristwatch 200 comprises a case 2 that houses a timepiece module 1 as a light emission and display device with an upper glass cover 3 composing the top of the case 2 through a packing 4. A dial plate 12 is provided above an analog hand mechanism 15 in the timepiece module 1 with a frame 5 shown in FIG. 20 provided on the top of the dial plate 12. The frame 5 abuts at its top on a protrusion 2*a* extending inwards from the inner periphery of the case 2 and is provided on the inner periphery of the case 2. A back cover 6 covers a lower end of the case 2. Two bands B are attached respectively to opposite ends 2B of the case 2.

The analog hand mechanism 15 comprises a hand shaft 17 that extends upwards through a hole 12*a* in the dial plate 12, and hands 18 such as hour and minute hands attached to the hands shaft 17 so as to rotate above the dial plate 12. The dial plate 12 and the hands 18 have light emitting portions 19 provided at predetermined positions thereon such that they are irradiated with rays from the ultraviolet ray-emitting elements 203 to thereby emit the corresponding colored lights.

A circuit board 13 is disposed on a lower surface of the analog hand mechanism 15. A pair of electrically conductive securing or connecting members 24 is connected at one end to a pair of connection terminals T of the circuit board 13 in a related hole 15*a* in the hand mechanism 15 open to the circuit board 13 side. A pair of legs 204 as contact or connection members of an ultraviolet ray emitting element 203 is disposed at a predetermined position on the frame (for example, corresponding to a respective one of the positions of the six and twelve o'clock on the dial plate 12 shown in FIG. 20). Each leg 204 has an L-like bend 205 comprising a first vertical portion 205*a* extending from a corner P of the L to a ray output 20*a* of the ultraviolet ray emitting element 203, and a second horizontal portion 205*b* extending rightward from the corner point P disposed within a space 15*b* provided at the outer periphery of the analog hand mechanism 15 below the periphery portion of the dial plate 12. The second horizontal portion 25*b* has an end extending into the corresponding hole 15*a* and pressed by a contact portion 24*a* of the securing member 24 against the circuit board 13. That is, the second horizontal portion 205*b* of the leg 204 is pressed by the securing member 24 so that the ultraviolet ray-emitting element 203 is supported securely and electrically connected to the circuit board 13.

Referring to FIGS. 21A, 21B, 21C and 21D, a method of making the ultraviolet ray emitting element 203 comprising a ray output 20*a* with a pair of bendable legs as electrode terminals or connection or contact members 204 will be described next as an example. The ray output 20*a* is similar to that shown in FIGS. 3A, 3B and 3C. The ultraviolet ray-emitting element 203 has a different form from the ultraviolet ray-emitting element 201 and therefore its elements are identified by different reference numerals.

Figure 21A:
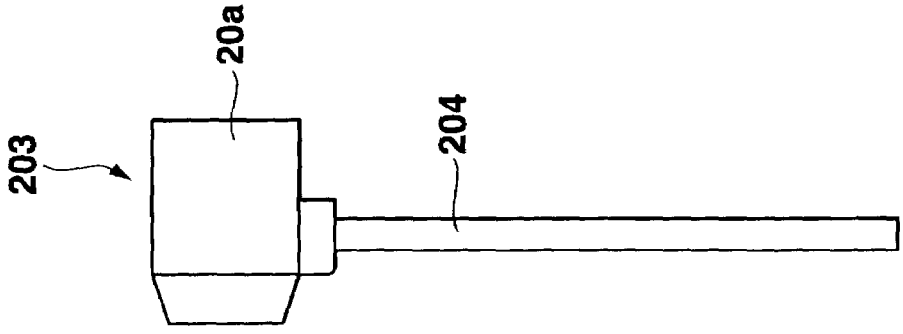
FIG. 21A illustrates an ultraviolet ray-emitting element having a pair of straight legs used in the fifth embodiment.
Figure 21B:
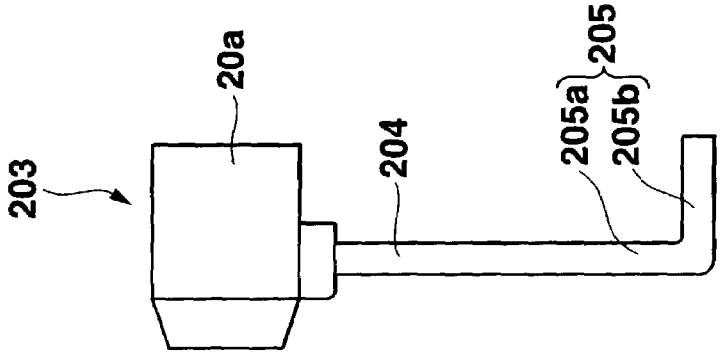
FIG. 21B illustrates an ultraviolet ray-emitting element having a pair of legs with a bend used in the fifth embodiment.
Figure 21C:
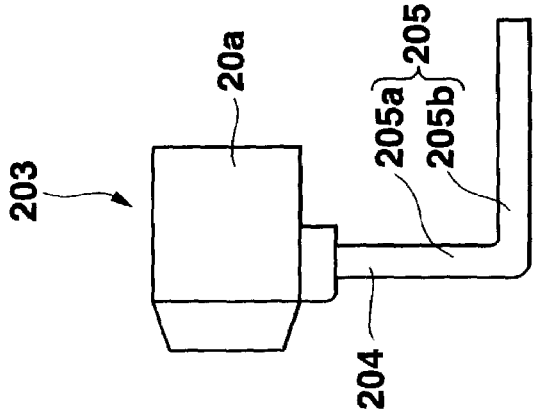
FIG. 21C illustrates an ultraviolet ray-emitting element having a pair of legs with another bend used in the fifth embodiment.
Figure 21D:
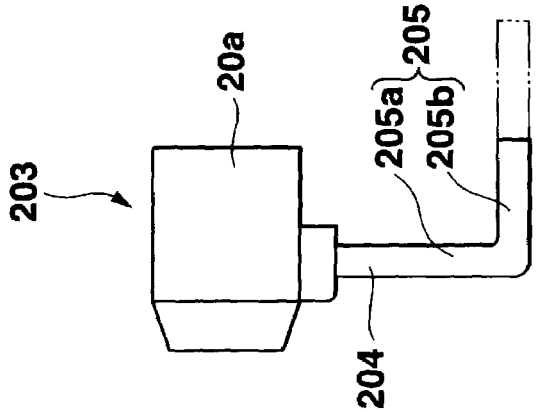
FIG. 21D illustrates an ultraviolet ray-emitting element having a pair of shortened legs with the bend used in the fifth embodiment.

The pair of legs 204 of the ultraviolet ray emitting element 203 of FIG. 21A are bent at a desired point P along their length to form bends 205 that include a first portion 205*a* and a second portion 205*b* bent at a desired angle (for example of 90 degrees) to the first portion, as shown in each of FIGS. 21B, 21C and 21D. The pair of legs 204 may be cut off at a desired point along their length to provide a desired adjusted length, as shown in FIG. 21D.

As just described above, the respective lengths of the first and second portions 205*a* and 205*b* composing each of the bends 205 of the legs 204 and the angle between the first and second portions are changeable.

The ultraviolet ray-emitting element 203 of FIG. 21A is similar in front view to the ultraviolet ray-emitting element 202 of FIG. 11A.

As described above, the lengths of; and the angle between, the first and second portions 205*a* and 205*b* of each of the legs 204 of the ultraviolet ray emitting element 203 are adjustable depending upon the positional relationship between the ultraviolet ray emitting element 203 and the connection terminals T of the circuit board. Therefore, the ultraviolet ray-emitting element 203 can be disposed to various shapes, designs and sizes of wristwatches.

Figure 22:
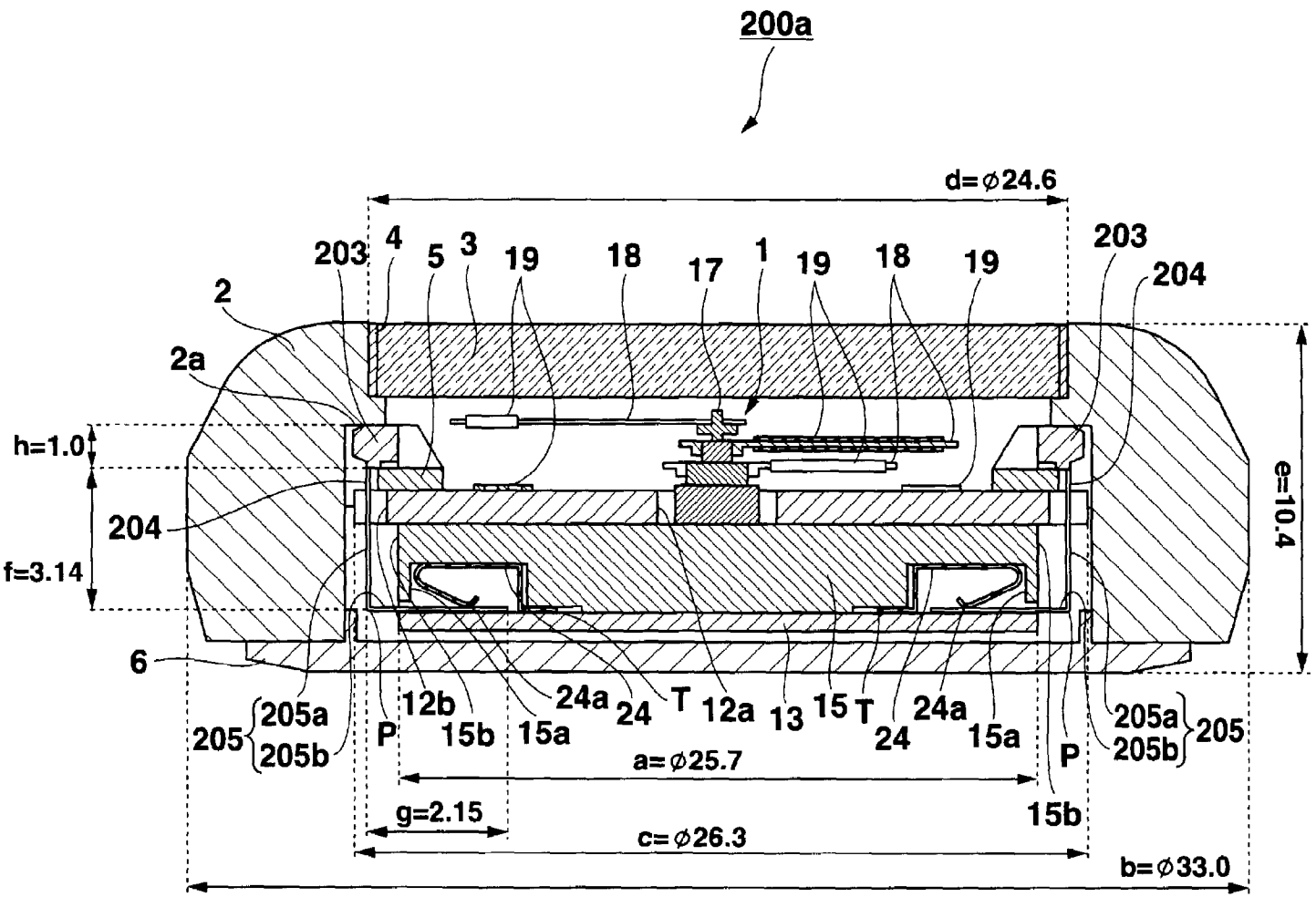
FIG. 22 is an enlarged cross-sectional view of an important portion of a first modification of the fifth embodiment.

For example, a wristwatch 200*a* of FIG. 22 is a first modification of the fifth embodiment that uses the same analog hand mechanism 15 as the wristwatch 200 of FIG. 19. It includes a case 2 and a dial plate 12 that are reduced in size. When the wristwatch 200*a* reduced in size is to be assembled, an ultraviolet ray emitting element 203 having a second shortened horizontal portion 205*b* compared to the ultraviolet ray emitting element 203 of the wristwatch 200 is disposed within the wristwatch 200*a*.

More specifically, for example in the wristwatch 200 of FIG. 19, the analog hand mechanism 15 has a diameter a of 25.7 mm; the case 2 has a diameter b of 38.0 mm; the dial plate 12 has a diameter c of 29.6 mm; the glass cover 3 has a diameter d of 28.2 mm; and the wristwatch has a thickness e of 10.4 mm. When the ultraviolet ray emitting element 203 is to be disposed in this wristwatch 200, it should have a first vertical portion 205*a* that has a length f of 3.14 mm, and a second horizontal portion 205*b* that has a length g of 3.65 mm in consideration of the positions of the other elements of the wristwatch 200 and the gap between each element of the wristwatch. The ray output 20*a* of the ultraviolet ray-emitting element 203 has a height h of 1.0 mm.

In contrast, in the wristwatch 200*a* of FIG. 22 the analog hand mechanism 15 has a diameter a of 25.7 mm, which is the same as the wristwatch 200 of FIG. 19; the case 2 has a diameter b of 33.0 mm; the dial plate 12 has a diameter c of 26.3 mm; the glass cover 3 has a diameter d of 24.6 mm; and the wristwatch has a thickness e of 10.4 mm. That is, the wristwatch 200*a* is small compared to the wristwatch 200. By using an ultraviolet ray emitting element 203 which has a first vertical portion 205*a* having a length f of 3.14 mm, and a second horizontal portion 205*b* having a length g of 2.15 mm in consideration of the positions of the other elements of the wristwatch 200 and the gap between each element of the wristwatch, the ultraviolet ray emitting element 203 can be disposed within the wristwatch 200*a*.

As just described above, even when analog hand mechanisms 15 having the same function and size are used in wristwatches different in size, especially in horizontal length, each of the ultraviolet ray emitting elements 203 can be disposed within a respective one of the wristwatches by adjusting the lengths of, and the angle between, the first and second portions 205*a* and 205*b* of each of the legs 204 at the bend 205 thereof. In the ultraviolet ray-emitting element 203, the ray output 20*a* has a height h of 1.0 mm.

Figure 23:
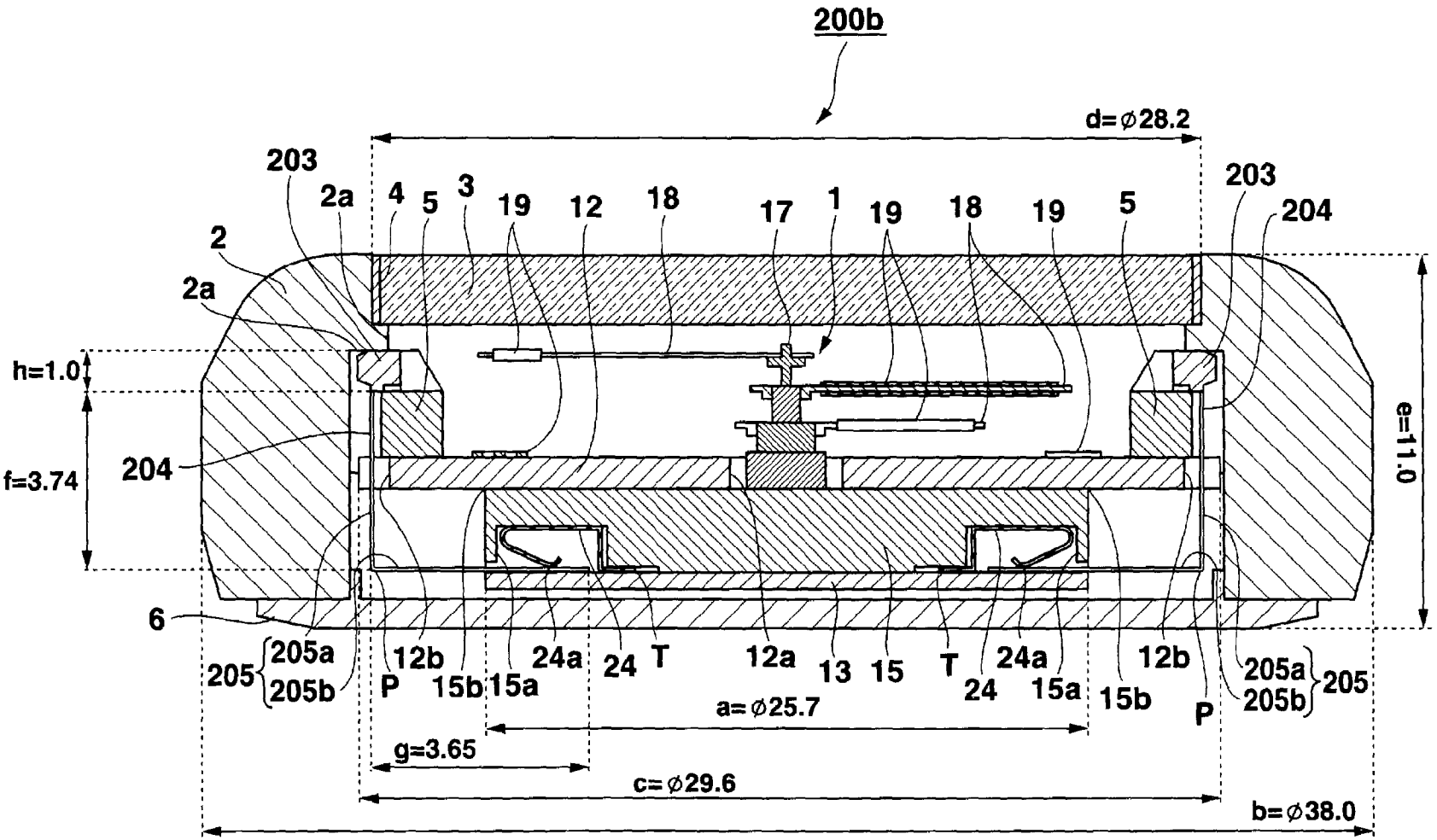
FIG. 23 is an enlarged cross-sectional view of an important portion of a second modification of the fifth embodiment.

A wristwatch 200*b* of FIG. 23 is a second modification of the fifth embodiment that is of a shock-resisting type. In this wristwatch, the gap between the hands 18 and the gap between each of the hands 18 and a respective one of the glass cover 3 and the dial plate 12 are set so as to be larger than those of the wristwatch 200 of FIG. 19 in order to prevent the hands 18 from contacting with each other and also to prevent the hands 18 from contacting with each of the glass cover 3 and the dial plate 12. Thus, the hand shaft 17 has an increased length and hence the frame 5 and the wristwatch 200*b* have increased thickness. In addition, the ray output 20*a* of the ultraviolet ray-emitting element 203 is provided at a position distant from the dial plate 12 than from the wristwatch 200 of FIG. 19. When such wristwatch 200*b* is assembled, including the same analog hand mechanism 15 as the wristwatch 200 of FIG. 19, an ultraviolet ray emitting element 203 having a first vertical portion 205*a* longer than the ultraviolet ray emitting element 203 of the wristwatch 200 can be disposed within the wristwatch 200*b*.

More specifically, in the wristwatch 200*b* of FIG. 23, the analog hand mechanism 15 has a diameter a of 25.7 mm that is the same as that of the wristwatch 200 of FIG. 19; the case 2 has a diameter b of 38.0 mm; the dial plate 12 has a diameter c of 29.6 mm; the glass cover 3 has a diameter d of 28.2 mm; and the wristwatch has a thickness e of 11.0 mm. That is, the wristwatch 200*b* is small in thickness compared to the wristwatch 200. By using an ultraviolet ray emitting element 203 which has a first vertical portion 205*a* having a length f of 3.74 mm, and a second horizontal portion 205*b* having a length g of 3.65 mm in consideration of the positions of the other elements of the wristwatch 200*b* and the gap between each element of the wristwatch, the ultraviolet ray emitting element 203 can be disposed within the wristwatch 200*b*.

As just described above, even when analog hand mechanisms 15 having the same function and size are used in wristwatches different in size, especially in height, each of the ultraviolet ray emitting element 203 can be disposed within a respective one of the wristwatches by adjusting the lengths of; and the angle between, the first and second portions 205*a* and 205*b* of each of the legs 204 at the bend 205 thereof. In the ultraviolet ray-emitting element 203, the ray output 20*a* has a height h of 1.0 mm.

As described above, by adjusting the lengths of the first and second portions 205*a* and 205*b* and the bend position P of each leg 204, each ultraviolet ray emitting element 203 can be disposed within a respective one of wristwatches different in configuration, design and size and having especially the same analog hand mechanism 15.

Generally, there is a great demand for wristwatches different in design and especially in outer size. By using the same analog hand mechanism 15 in each of the wristwatches different in design and outer size, the trouble to handle various analog hand mechanisms 15 is eliminated and the manufacturing cost of the analog hand mechanisms 15 is reduced compared to the case in which the various analog hand mechanisms 15 are used in the respective wristwatches different in design and outer size.

That is, even when the same analog hand mechanism 15 is used in each of the wristwatches different in outer size, the ultraviolet ray emitting element 203 of this (fifth) embodiment can be easily disposed harmonically within a respective one of the various wristwatches by adjusting the length of the legs 204, their bend position P, their first and second portions 205*a* and 205*b*, and the angle between the first and second portions and changing a cutting point along the length of the second portions 205*b* such that the wristwatches effectively function as light emission and display devices.

As described above, according to the wristwatch of the fifth embodiment, even when the ultraviolet ray emitting element 203 is distant from the circuit board 13, they can be electrically connected through the electrically conductive securing members 24, and the ultraviolet ray emitting element 203 can effectively irradiate the light emitting areas 19 distant from the circuit board 13 with ultraviolet rays, as in the first embodiment.

The ultraviolet ray emitting element 203 can emit ultraviolet rays on demand to thereby cause the respective light emitting areas 19 to emit the corresponding colored rays. The ultraviolet ray-emitting element 203 has the pair of legs 204 pressed and secured releasably. Therefore, the ultraviolet ray-emitting element 203 is electrically connected to the circuit board 13 of the timepiece module 1 in a state where the ultraviolet ray-emitting element 203 can be exchanged easily with another. Especially, since the legs 204 are bendable and cuttable at any position along the length thereof, the ultraviolet ray emitting elements 203 of the same function and size can be disposed respectively within wristwatches different in configuration, design and size by changing the lengths of the legs 204 thereof.

While in the first-fifth embodiments the ray emitting elements including the ultraviolet ray emitting elements are illustrated, the present invention is not limited to these particular cases. The ray emitting elements may include infrared or visible ray emitting elements and the light emitting areas that receive rays from those elements and emit the corresponding colored rays may be made of a fluorescent material. The number of ray emitting elements and the positions where they are disposed are not limited.

The space between the frame and the circuit board may be determined depending upon the presence of the intervening members or the position of the frame.

In the present invention, the electronic apparatus are not limited to the wristwatches, but may include various other devices such as portable telephones and car meters.

The frames may take any shape, and the specific detailed structures of the electronic apparatus may be changeable on demand.

The present invention provides a light emission and display device (for example, timepiece module 1) comprising a ray emitting element (for example, ultraviolet ray emitting element 201), light emitting areas (for example, shown by 19) for emitting the corresponding colored rays in reaction to rays from the ray emitting element, a frame (for example, shown by 5) on which the ray emitting element is disposed, a connection terminal (for example, shown by T) disposed at a predetermined position below the frame, and a connection member (for example, shown by 21A) for connecting the connection terminal electrically to the ray emitting element.

According to the present invention, the ray-emitting element disposed on the frame can be electrically connected by the connection member in a stabilized manner to the connection terminal disposed at a predetermined position below the frame. The ray emitting element can be disposed at a desired position to emit rays to thereby strike the light emitting areas and hence to cause the same to emit the corresponding colored lights effectively.

Since the connection member is changeable in length and shape depending upon the positional relationship between the ray emitting element and the connection terminal, restriction on the positional relationship between the ray emitting element and the connection terminal is reduced. Thus, the degrees of freedom of disposing the ray emitting element and selecting the size, etc., of the light emission and display device are increased.

In the first embodiment of the light emission and display device, the connection member comprises the electrically conductive contact member (for example, 21) abutting at one end on the terminal of the ray emitting element, and the electrically-conductive pressing member (coil spring 22) connected electrically to the connection terminal and abutting on the other end of the contact member for pressing the contact member against the ray emitting element.

According to this first embodiment, even when the ray emitting element is distant from the connection terminal, the former can be connected electrically to the latter through the electrically conductive connection member and the light emitting areas distant from the connection terminal can be irradiated effectively with rays from the ray emitting element.

The electrically conductive contact member abutting on the terminal of the ray emitting element is pressed against the ray emitting element by the electrically conductive pressing member that is connected electrically to the connection terminal to thereby cause the rays emitting element to electrically connect to the connection terminal. Therefore, even when there is an error in the space between the ray emitting element and the connection terminal or shocks are given to the apparatus, the connection between the ray emitting element and the connection terminal is maintained in a stable state.

In the second embodiment of the light emission and display device, the connection member comprises the electrically conductive pressing member (for example, coil spring 22A) connected electrically at one end to the connection terminal and abutting at the other end on the terminal of the ray emitting element so as to be pressed against the ray emitting element.

According to this second embodiment, even when the ray emitting element is distant from the connection terminal, the former can be connected electrically to the latter through the electrically conductive pressing member, and the light emitting areas distant from the connection terminal can be irradiated effectively with rays from the ray emitting element.

The electrically conductive pressing member connected electrically to the connection terminal abuts on the terminal of the ray-emitting element to be pressed against the ray-emitting element. Therefore, even when there is an error in the space between the ray emitting element and the connection terminal or shocks are given to the wristwatch, the connection between the ray emitting element and the connection terminal is maintained in a stable state.

The pair of simple pressing members is used to electrically connect the ray emitting element and the connection terminal, and therefore the number of parts to be used is reduced.

In the fifth embodiment, the light emission and display device (for example, wristwatch 200) comprises the ray emitting element (for example, ultraviolet ray emitting element 203) and the light emitting area (for example, 19) that receives rays from the ray emitting element to thereby emit the colored light. The light emission and display device comprises the frame (for example, 5) on which the ray emitting element is disposed, the connection terminal (for example, T) disposed at the predetermined position below the frame, and the connection member (for example, leg

204) for electrically connecting the connection terminal to the ray emitting element, wherein the connection member has the bend (for example, 205, first and second portions 205*a* and 205*b*) at the position (for example, P) determined depending upon the positional relationship between the ray-emitting element and the connection terminal.

According to the fifth embodiment, the connection member that connects the connection terminal electrically to the light emitting element has the bend at the position determined depending upon the positional relationship between the light emission element and the connection terminal. Thus, even when the ray-emitting element is disposed at the predetermined space from the connection terminal, both are connected electrically to each other in a stabilized manner by the connection member. In addition, the light emitting areas are caused to emit the corresponding colored lights by causing the ray emitting element disposed at the desired position to emit rays that strike the light emitting areas effectively.

In the fifth embodiment of the light emission and display device, the connection member is bent at the angle determined depending upon the positional relationship between the ray emitting element and the connection terminal such that the ray emitting element may be disposed at the optimal position.

In the third and fifth embodiments of the light emission and display device the connection member comprises the electrically contact member (or example, 20*d* or 204) fixed at one end to the terminal of the ray emitting element, and the electrically conductive securing member (for example, 24) connected electrically to the connection terminal for securing the other end of the contact member at the predetermined position.

According to the third and fifth embodiments, the electrically conductive contact member secured at one end to the terminal of the ray-emitting element is secured at the predetermined position by the electrically conductive securing member. Therefore, even when the ray-emitting element is distant from the connection terminal, the ray-emitting element is connected electrically to the connection terminal. In addition, the light emitting area distant from the connection terminal is effectively irradiated with rays from the ray-emitting element.

For example, by connecting the conductive contact member disconnectably to the conductive securing member, the ray emitting element and the frame may be exchanged easily with others.

The fifth embodiment of the light emission and display device further comprises the intermediate member (for example, analog hand mechanism 15) disposed between the frame and the connection terminal. The electrically conductive contact member comprises the first portion (for example, 204*a*) extending from the ray emitting element to the bend position and the second portion (for example, 204*b*) extending from the bend position to the connection terminal. The length of the first portion or the angle between the first and second portions is changeable depending upon the height of the intermediate member. The length of the second portion or the angle between the first and second portions is changeable depending upon the horizontal distance between the ray emitting element and the connection terminal.

Since in the light emission and display device the electrically conductive contact member comprises the first portion changeable in length or angle depending upon the height of the intermediate member and the second portion changeable in length or angle depending upon the horizontal distance between the ray emitting element and the connection terminal, the ray emitting element is connected electrically to the connection terminal depending upon the size and shape of the intermediate member and the distance and positional relationship between the ray emitting element and the connection terminal. Thus, the degree of freedom of disposing the ray-emitting element is enhanced to thereby provide various light emission and display devices different in design and size.

In the fourth embodiment of the light emission and display device, the connection member comprises the electrically conductive contact member (for example, 20*d*) fixed at one end to the terminal of the ray emitting element and soldered at the other end to the connection terminal.

Of course, this fourth embodiment produces advantageous effects similar to those produced by the present invention described in the above paragraphs (0054) and (0055). Even when the ray emitting element is distant from the connection terminal, the electrically conductive contact member fixed at one end to the ray emitting element's terminal is soldered at the other end to the connection terminal to thereby connect the ray emitting element to the connection terminal electrically. In addition, the light emitting area distant from the connection terminal can be irradiated effectively with the rays from the ray-emitting element.

By this soldering, the number of parts to be used is reduced and inexpensive connection is achieved to thereby reduce the manufacturing cost of the resulting wristwatches.

The inventive light emission and display device further comprises the intermediate member (for example, upper housing 10, dial plate 12, analog hand mechanism 15) disposed between the frame and the connection terminal, the connection member having the intermediate portion disposed in the hole (5*a*, 10*a*, 12*b* or 15*b*) in the intermediate member.

According to this device, when the intermediate member is provided between the frame and the connection terminal, the connection member extends through the holes in the intermediate members so as to connect the ray emitting element and the connection terminal. Thus, the connection member is secured in the stabilized manner.

In the light emission and display device according to the present invention, this apparatus, the connection terminal is formed on the circuit board. Thus, the ray emitting element is connected to the circuit board, so that the light emitting area can emit a colored light peculiar thereto.

In the electronic apparatus (for example, wristwatch 100 or 200) comprising the inventive light emission and display device in the case (for example, timepiece case 2), the ray emitting element is connected in the stabilized manner to the connection terminal by the connection means determined depending upon the distance between the ray emitting element and the connection terminal, etc. Thus, the light emission and display device can be provided in each of various electronic devices.

What is claimed is:

1. A light emission and display device comprising:

a light emitting element for emitting a light;

a light emitting section for emitting a colored light upon receipt of the light from the light emitting element;

a frame member for supporting the light emitting element;

a circuit board disposed beneath the frame member;

a contact terminal at a predetermined position on the circuit board;

a conductive contact member comprising a first end which is fixed to the light emitting element and a second end of which extends toward the circuit board; and a conductive securing member which is provided on the circuit board, and which comprises a first end which is electrically connected to the contact terminal and a second end which comprises an elastic abutting portion;

wherein the second end of the contact member extending toward the circuit board is bent to be inserted between the elastic abutting portion of the securing member and the circuit board, such that the elastic abutting portion is elastically deformed to press on and hold the inserted second end of the contact member between the elastic abutting portion and the circuit board, and such that the securing member is electrically connected to the contact member.

2. An electronic apparatus comprising:

a case; and the light emission and display device of claim 1 housed in the case.

* * * * *